US006625575B2

(12) United States Patent
Chihara

(10) Patent No.: US 6,625,575 B2
(45) Date of Patent: Sep. 23, 2003

(54) INTONATION CONTROL METHOD FOR TEXT-TO-SPEECH CONVERSION

(75) Inventor: Keiichi Chihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 429 days.

(21) Appl. No.: 09/752,774

(22) Filed: Jan. 3, 2001

(65) Prior Publication Data

US 2001/0021906 A1 Sep. 13, 2001

(30) Foreign Application Priority Data

Mar. 3, 2000 (JP) ..... 2000-058821

(51) Int. Cl.[7] ..... G10L 13/08
(52) U.S. Cl. ..... 704/260
(58) Field of Search ..... 704/260

(56) References Cited

U.S. PATENT DOCUMENTS 5,642,466 A * 6/1997 Narayan ..... 704/260
5,796,916 A * 8/1998 Meredith ..... 704/258
5,950,152 A * 9/1999 Arai et al. ..... 704/207
6,101,470 A * 8/2000 Eide et al. ..... 704/260
6,226,614 B1 * 5/2001 Mizuno et al. ..... 704/260
6,334,106 B1 * 12/2001 Mizuno et al. ..... 704/260
6,405,169 B1 * 6/2002 Kondo et al. ..... 704/258

* cited by examiner

*Primary Examiner*—Tālivaldis Ivars Šmits
(74) *Attorney, Agent, or Firm*—Rabin & Berdo, P.C.

(57) ABSTRACT

In a text-to-speech conversion system, the intonation of a word is controlled by modifying a point pitch pattern of the word. The modification is made in relation to a pitch slope line joining the first point pitch to the last point pitch of the word, these two point pitches being left invariant. Alternatively, the modification is made in relation to a typical speech pitch, which is left invariant. The modification may also be made by classifying the point pitches as high and low, and applying separate shifts to the high and low pitches. These methods avoid the generation of extremely high or low pitches, and avoid the unwanted alteration of the average pitch level.

32 Claims, 24 Drawing Sheets

INTONATION CONTROL METHOD FOR TEXT-TO-SPEECH CONVERSION

BACKGROUND OF THE INVENTION

The present invention relates to text-to-speech conversion technology, more particularly to a method of intonation control in synthesized speech.

Text-to-speech conversion is a technology that converts ordinary text, of the type that people read every day, to spoken words, and outputs a speech signal. Because of its unlimited output vocabulary, this technology has potential uses in many fields, as a replacement for pre-recorded speech synthesis.

A typical speech synthesis system of the text-to-speech type has the structure shown in FIG. 1. The input is a machine-readable form of ordinary text. A text analyzer 101 analyzes the input text and generates a sequence of phonetic and prosodic symbols that use predefined character strings (referred to below as an intermediate language) to indicate pronunciation, accent, intonation, and other information. Incidentally, the illustrated system processes Japanese text, and the accent referred to herein is a pitch accent.

To generate the intermediate-language representation, the text analyzer 101 carries out linguistic processing such as morphemic analysis and semantic analysis, referring to a word dictionary 104 that gives the pronunciation, accent, and other information about each word. The resulting intermediate-language representation is processed by a parameter generator 102 to determine various synthesis parameters. These parameters from patterns of speech elements (sound types), phonation times (sound durations), phonation power (intensity of sound), fundamental frequency (voice pitch), and the like. The synthesis parameters are sent to a waveform generator 103, which generates synthesized speech waveforms by referring to a speech-element dictionary 105. The speech-element dictionary 105 is, for example, a read-only memory (ROM) storing speech elements and other information. The stored speech elements are the basic units of speech from which waveforms are synthesized. There are many types of speech elements, corresponding to different sounds, for example. The synthesized waveforms are reproduced through a loudspeaker and heard as synthesized speech.

The internal structure of the parameter generator 102 is shown in FIG. 2. The input intermediate language representation comprises phonetic character sequences accompanied by prosodic information such as accent position, positions of pauses, and so on. The parameters determined from this information include the time variations in pitch (referred to below as the pitch pattern), phonation power, the phonation time of each phoneme, the addresses of speech elements stored in the speech-element dictionary, and other parameters (referred to below as synthesis parameters) needed for synthesizing speech waveforms.

In the parameter generator 102, an intermediate language analyzer (ILA) 201 analyzes the input intermediate language, identifies word boundaries from word-delimiting symbols and breath-group symbols, and analyzes the accent symbols to find the moraic position of the accent nucleus of each word. A breath group is a unit of text that is spoken in one breath. A mora, in Japanese, is a short syllable or part of a long syllable. A voiced mora includes one vowel phoneme or the nasal /n/ phoneme. The accent nucleus, in Japanese, is the position where the pitch drops sharply. A word with an accent nucleus in the first mora is said to have a type-one accent. A word with an accent nucleus in the n-th mora is said to have a type-n accent (n being an integer greater than one), and these words are said to have a rising-and-falling accent. Words with no accent nucleus are said to have a type-zero accent or a flat accent; examples include the Japanese words 'shimbun' (newspaper) and 'pasokon' (personal computer).

A pitch pattern generator 202 calculates the pitch frequency of each voiced mora from the prosodic information in the intermediate language. In conventional Japanese text-to-speech conversion, pitch patterns are controlled by estimating the pitch frequency at the center of the vowel (or nasal /n/) in the mora, and using linear interpolation or spline interpolation between these positions; this technique is referred to as point-pitch modeling. Central vowel pitches are estimated by well-known statistical techniques such as Chikio Hayashi's first quantification method. Control factors include, for example, the accent type of the word to which the vowel belongs, the position of the mora relative to the start of the word, the position of the mora within the breath group, and the phonemic type of the mora. The collection of estimated vowel-centered pitches will be referred to below as the point pitch pattern, while the entire pattern generated by interpolation will be referred to simply as the pitch pattern. The pitch pattern is calculated on the basis of the phonation time of each phoneme as determined by a phonation time generator 203, described below. If the user has specified a desired intonation level or a desired voice pitch, corresponding processing is carried out. Voice pitch is typically specifiable on about five to ten levels, for each of which a predetermined constant is added to the calculated pitch values. Intonation is typically specifiable on three to five levels, for each of which the calculated pitch values are partly multiplied by a predetermined constant. These control features are provided to enable specific words in a sentence to be emphasized or de-emphasized. Further information will be given later, as these are the features with which the present invention is concerned.

The phonation time generator 203 determines the length of each phoneme from the phonetic character sequences and prosodic symbols. Common methods of determining the phonation time include statistical techniques such as the above-mentioned quantification method, using the preceding and following phoneme types, or moraic position within the word or breath group. If the user has specified a desired speech speed, the phonation times are expanded or contracted accordingly. Speech speed can typically by specified on about five to ten levels; the calculated phonation times are multiplied by a predetermined constant for each level. Specifically, the phonation times are lengthened to slow down the speech, and shortened to speed up the speech.

A phonation power generator 204 calculates the amplitude of the waveform of each phoneme from the phonetic character sequences. The waveform amplitude values are determined empirically from factors such as the phoneme type (/a, e, i, o, u/, for example) and moraic position in the breath group. The phonation power generator 204 also determines the power transitions within each mora: the initial interval in which the amplitude value gradually increases, the steady-state interval that follows, and the final interval in which the amplitude value gradually decreases. Tables of numerical values are usually used to carry out this power control. If the user has specified a desired voice volume level, the amplitude values are increased or decreased accordingly. Voice volume can typically be specified on about ten levels. The amplitude values are multiplied by a predetermined constant for each level.

A speech element selector 205 determines the addresses in the speech-element dictionary 105 of the speech elements needed for expressing the phonetic character sequences. The speech elements stored in the speech-element dictionary 105 include elements derived from several types of voices, normally including at least one male voice and at least one female voice. The user specifies a desired voice type, and the speech element addresses are determined accordingly.

The pitch pattern, phonation powers, phonation times, and speech element addresses determined as described above are supplied to a synthesis parameter generator (SPG) 206, which generates the synthesis parameters. The synthesis parameters describe waveform frames with a typical length of about eight milliseconds (8 ms). The synthesis parameters are sent to the waveform generator 103.

The conventional techniques for controlling the intonation of a pitch pattern will now be described in more detail, with reference to the functional block diagram of the pitch pattern generator 202 shown in FIG. 3.

The intermediate language analyzer 201 supplies phonetic symbol sequences and prosodic symbols to a pitch estimator 301, which estimates the central vowel pitch of each voiced mora. The pitch is estimated by statistical methods, such as Hayashi's first quantification method, on the basis of natural speech data, using a pre-trained prediction table 302. The point pitch pattern determined by the pitch estimator 301 is passed to a switching unit 303. If the user has not designated an intonation level, the switching unit 303 passes the point pitch pattern directly to a pitch-pattern interpolator 307. If the user has designated an intonation level, the point pitch pattern is passed to a minimum pitch finder 304. The minimum pitch finder 304 processes each word by finding the minimum central vowel pitch or point pitch in the word. An accent component calculator 305 calculates the difference between each point pitch and the minimum pitch (this difference is the accent component). A pitch modifier 306 then multiplies the accent component values by a coefficient determined according to the intonation level designated by the user, thereby modifying the point pitch pattern, and the modified pattern is supplied to the pitch-pattern interpolator 307. The pitch-pattern interpolator 307 carries out linear interpolation or spline interpolation, using the supplied point pitch pattern and the phonation times calculated by the phonation time generator 203, and sends the results to the synthesis parameter generator 206. If the user has specified a desired voice pitch, a corresponding constant is added to or subtracted from the point pitch values determined by the pitch estimator 301, although this is not indicated in the drawing.

Conventional pitch-pattern intonation control is illustrated in FIG. 4. The vertical axis represents pitch frequency in hertz (Hz); the horizontal axis represents time, with boundaries between phonemes indicated by vertical dashed lines. The illustrated example is for an utterance of the Japanese phrase 'onsei shori' (meaning 'speech processing'). The black dots joined by thick lines are the point pitch pattern estimated by statistical techniques. Also indicated are modified point pitch patterns in which the user has specified intonation levels of x1.5 (white squares) and x0.5 (white dots). The prior art begins by searching for the minimum estimated pitch, which occurs in the vowel /i/ in the final mora 'ri.' This estimated pitch will be denoted 'min' below. Next, taking the /n/ phoneme for example, its pitch (A) relative to the minimum pitch is calculated. The pitch values (B) for x0.5 intonation and (C) for x1.5 intonation are then calculated from A as follows, an asterisk being used to indicate multiplication.

$$B = (A * 0.5) + \min \quad (1)$$

$$C = (A * 1.5) + \min \quad (2)$$

The other point pitches are modified in the same way, working from the first mora to the last, to carry out intonation control.

One problem with the prior art of intonation control as described above is that, although the purpose is only to control intonation, the control process also raises or lowers the voice pitch. A comparison of the three pitch patterns in FIG. 4 makes it clear that the average pitch of the spoken phrase is raised in the x1.5 intonation pattern, and lowered in the x0.5 intonation pattern. When intonation control is designated only for selected words in a sentence, these words will be uttered at a higher or lower pitch than other words in the same sentence, destroying the balance of the synthesized speech in an extremely annoying manner.

Similarly, if a strong intonation level is specified for an entire sentence, or an entire text, this simultaneously raises the voice pitch, and if a weak intonation level is specified, the voice pitch is lowered. Consequently, the synthesized speech does not have the desired voice pitch.

A further problem is illustrated in FIG. 5, which shows point pitch patterns for each accent type in a word with five morae. Pitch frequency is indicated on the vertical axis; moraic position is indicated on the horizontal axis, the first mora being numbered zero (0). Reference characters from 401 to 405 designate accent types one to five, respectively. The type-five accent pattern 405, which lacks an accent nucleus, may also be treated as a type-zero accent pattern. More generally, in a word with n morae and a type-n or type-zero accent, the pitch does not fall steeply at any point. We shall focus here on a word with a type-zero accent. A basic feature of the type-zero accent is that the first mora is low in pitch and the second mora is high, but if the second mora represents a dependent sound, there is a strong tendency for the first mora and second mora to be pronounced together with a comparatively flat intonation, as if they were a single mora, forcing the pitch of the first mora to be relatively high. In Japanese, this occurs when the second mora is a dependent vowel, the second part of a long vowel, or the nasal /n/phoneme.

The prior art operates on the difference between each point pitch and the minimum pitch. When a word with a type-zero accent has one of the properties described above, the minimum pitch is the pitch of the first mora, which is pulled up by the second mora, so that the entire word is in a sustained high-pitch state and the accent is not accurately delineated. Adequate intonation control of such words is not achieved in the prior art. A user seeking to emphasize or de-emphasize these words by intonation control finds his or her efforts frustrated; hardly any perceptible intonation change can be produced.

Yet another problem is that the final pitch of the last word in a sentence tends to be much lower than the other pitches in the same sentence. When intonation control is carried out on this last word, since its minimum pitch occurs in the last mora, the differences between other pitches and this minimum pitch are extremely large. Accordingly, if the intonation level is raised, the pitch tends to become extremely high near the beginning of the word, causing the word to be uttered with an unnatural squeak.

A further problem is that the speech-element dictionary is normally created from speech data derived from meaningless words spoken in a monotone. This approach yields excellent clarity when the pitch of the synthesized speech is close to the monotone pitch, but as the pitch of the synthesized speech departs from that pitch, the synthesized words become increasingly distorted. Conventional intonation control makes the same type of modifications regardless of the general pitch level of the word being modified. If the general pitch level is high to begin with, and the intonation level is increased, the high pitches become still higher, leading to objectionable distortion and unnatural synthesized speech.

SUMMARY OF THE INVENTION

A first object of the present invention is to control the intonation of the last word in a sentence without producing extremely high pitches near the beginning of this last word.

A second object is to enable accurate intonation control to be carried out on all words, regardless of their accent type.

A third object is to carry out intonation control while maintaining a substantially invariant average pitch.

A fourth object is to carry out intonation control while staying close enough to a natural speaking pitch to avoid excessive distortion of synthesized speech sounds.

The invention provides a method of controlling the intonation of synthesized speech according to a designated intonation level, and text-to-speech conversion apparatus employing the invented method.

According to a first aspect of the invention, the method includes the following steps:

- obtaining an original point pitch pattern of a word to be synthesized;
- constructing a pitch slope line from the first point pitch to the last point pitch in the original point pitch pattern;
- modifying each intermediate point pitch in the original point pitch pattern by finding a temporally matching point on the pitch slope line and adjusting the distance of the intermediate point pitch from the temporally matching point according to the designated intonation level; and
- synthesizing a speech signal from the modified point pitch pattern.

This aspect of the invention achieves the first object stated above, and to some extent the fourth object. The first point pitch of each word is left unchanged, and other point pitches near the beginning of the word are not greatly increased.

According to a second aspect of the invention, the method includes the following steps:

- obtaining an original point pitch pattern of a word to be synthesized;
- generating a simplified pitch pattern by classifying each point pitch in the original point pitch pattern as high or low;
- calculating a high pitch shift and a low pitch shift according to the designated intonation level;
- adding the high pitch shift to each high point pitch in the original point pitch pattern, and adding the low pitch shift to each low point pitch in the original point pitch pattern, thereby obtaining a modified point pitch pattern; and
- synthesizing a speech signal from the modified point pitch pattern.

In this aspect of the invention, the simplified pitch pattern may be generated according to the accent type of the word and the dependent or independent character of the second point pitch, thereby achieving the second object stated above.

The high and low pitch shifts may have equal magnitude and opposite sign, so that the third object is substantially achieved.

Alternatively, the high pitch shift may be set to zero when the word as a whole is high-pitched, and the low pitch shift may be set to zero when the word as a whole is low-pitched, thereby achieving the fourth object. Whether the word as a whole is high-pitched or low-pitched can be determined by comparing the maximum and minimum point pitches in the original point pitch pattern with a predetermined speech pitch.

According to a third aspect of the invention, the method includes the following steps:

- obtaining an original point pitch pattern of a word to be synthesized;
- designating an invariant pitch representing a typical pitch level of the synthesized speech;
- calculating a constant value according to the invariant pitch;
- modifying each point pitch in the original point pitch pattern according to the designated intonation level;
- further modifying each point pitch by adding the calculated constant value; and
- synthesizing a speech signal from the twice-modified point pitch pattern.

The constant value is calculated so that a point pitch having the invariant pitch in the original point pitch pattern also has the invariant pitch in the final modified point pitch pattern. The third object is thereby achieved. The first, third, and fourth objects are also achieved to some extent.

DETAILED DESCRIPTION OF THE INVENTION

Figure 1:
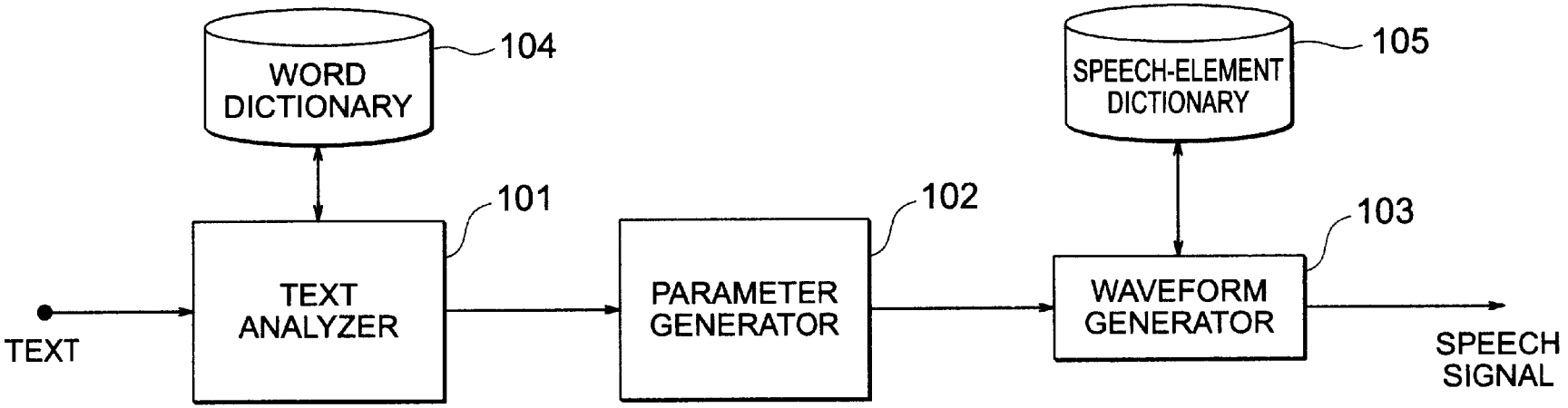
FIG. 1 PRIOR ART
FIG. 1 is a block diagram of a conventional text-to-speech conversion system.
Figure 2:
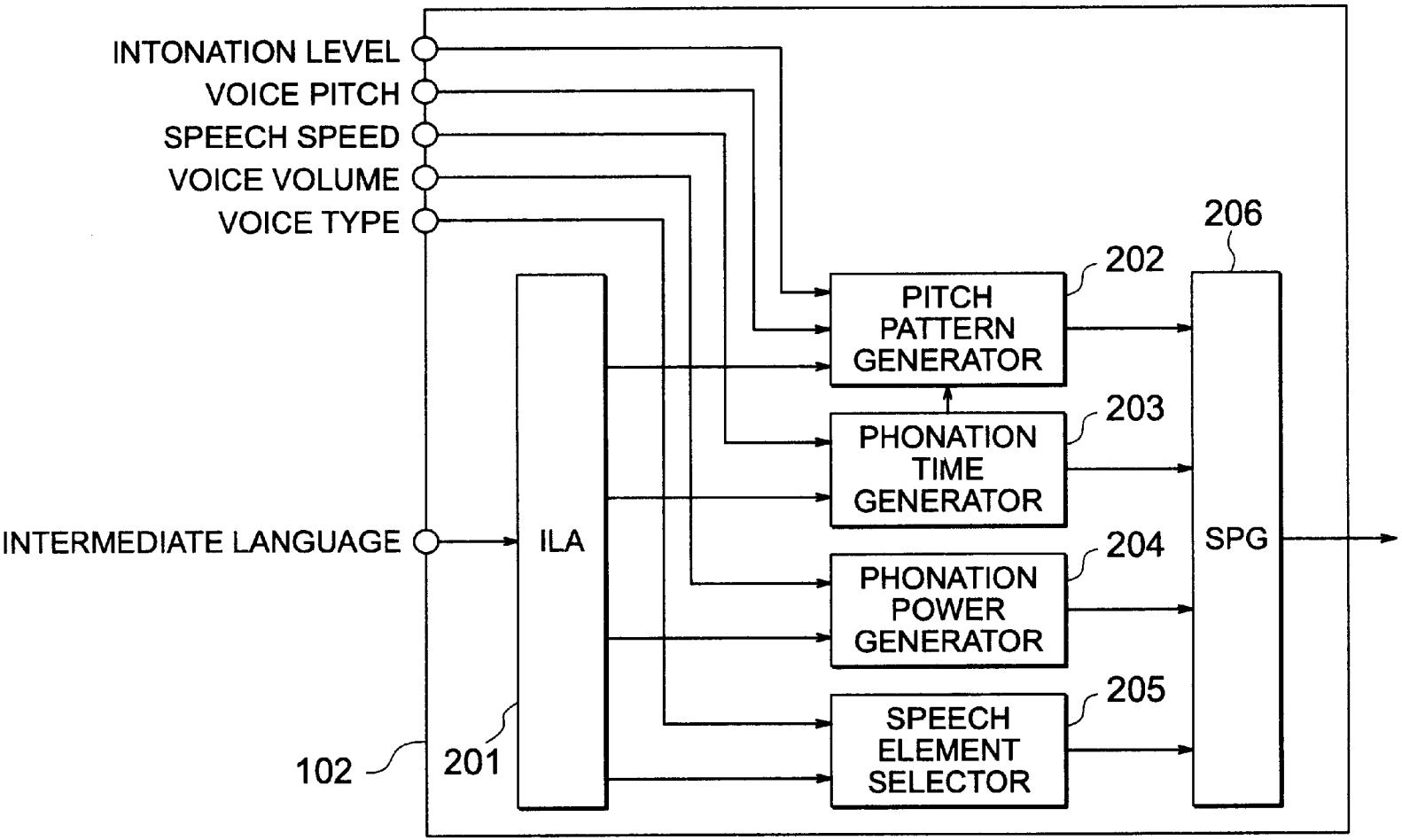
FIG. 2 PRIOR ART
FIG. 2 is a more detailed block diagram of the parameter generator in FIG. 1.
Figure 3:
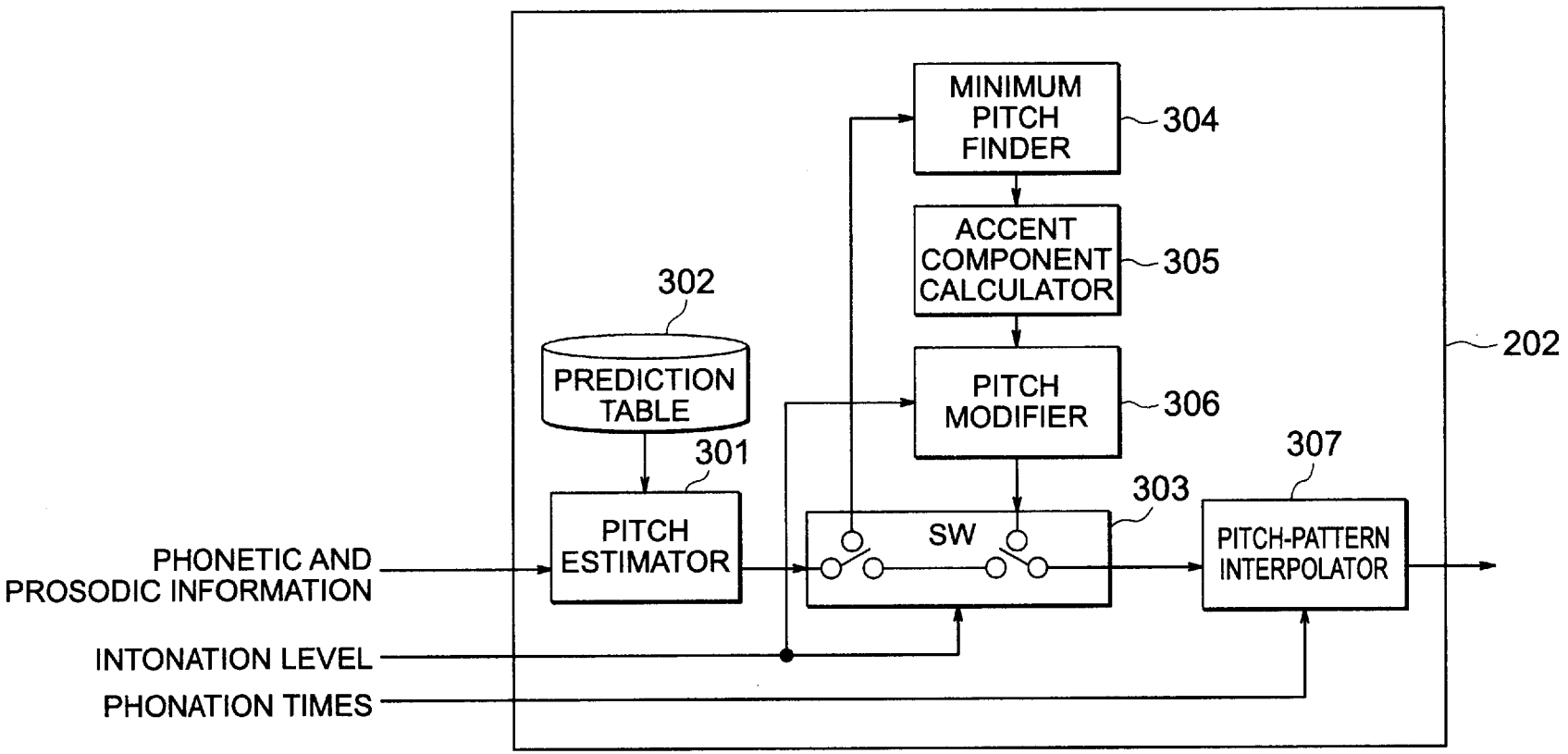
FIG. 3 PRIOR ART
FIG. 3 is a more detailed block diagram of the pitch pattern generator in FIG. 2.
Figure 4:
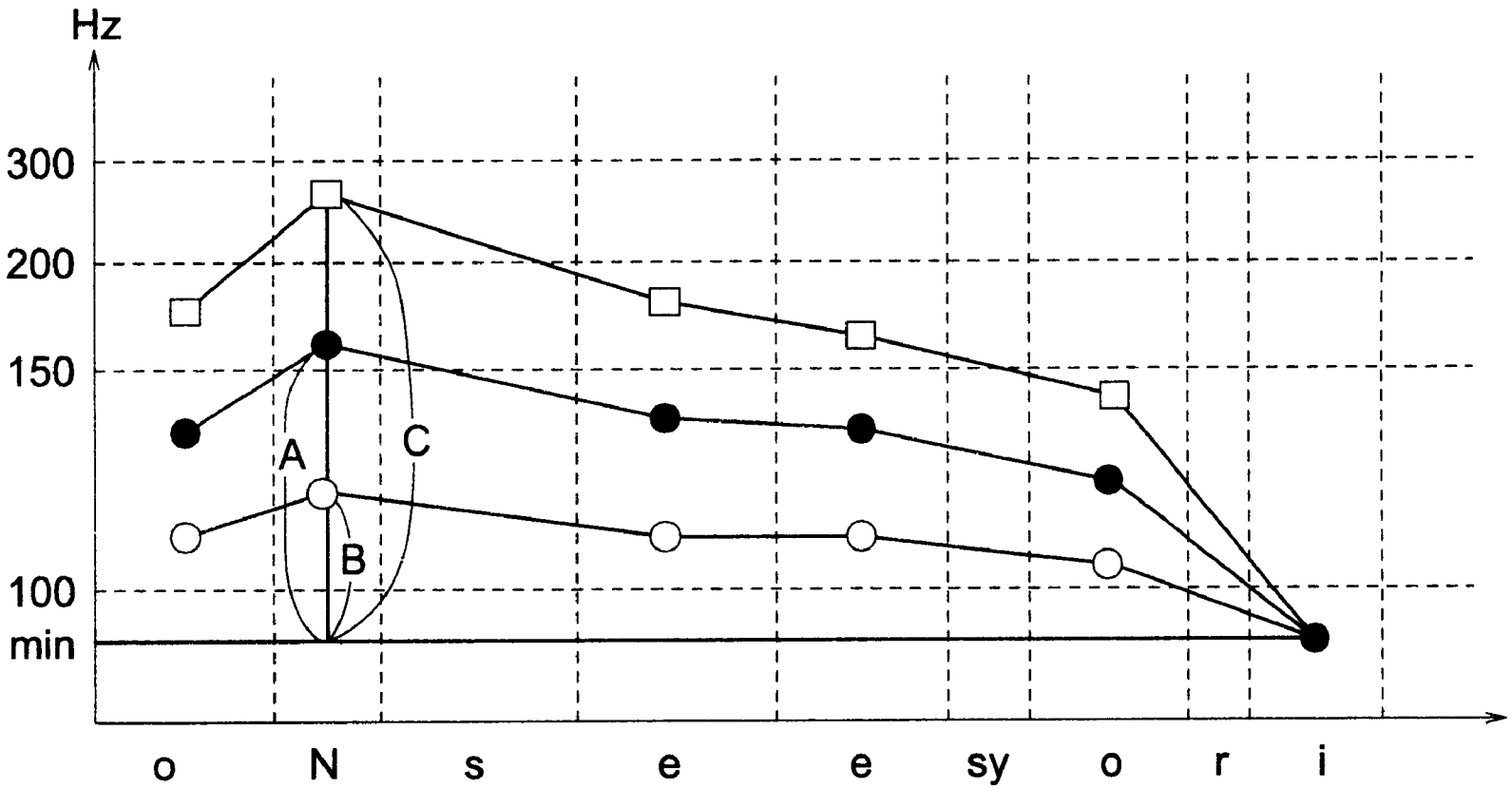
FIG. 4 PRIOR ART
FIG. 4 illustrates conventional modifications of a point pitch pattern.
Figure 5:
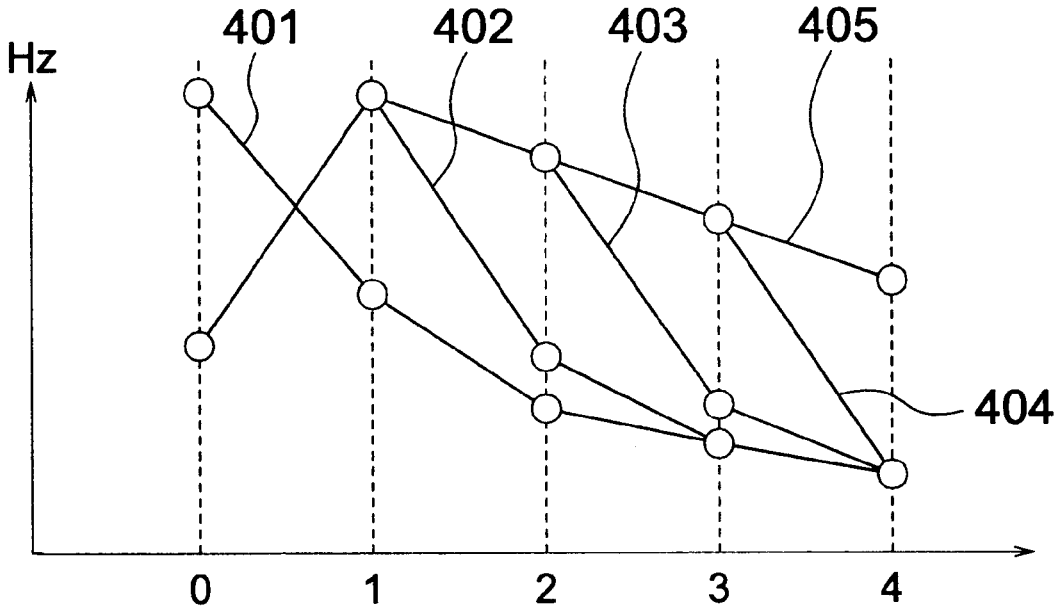
FIG. 5 illustrates different pitch accent types.

Embodiments of the invention will be described with reference to the attached drawings. The embodiments concern the pitch pattern generator 202 in FIG. 2; they replace the structure shown in FIG. 3 with various novel structures. It will be assumed that the embodiments include the other elements shown in FIGS. 1 and 2 and that these elements operate as in the prior art. As indicated in FIG. 2, the user may designate an overall voice pitch, speech speed, and voice volume, but these features will not be explicitly described in the embodiments.

For simplicity, unvoiced morae will be ignored. Each mora will thus have one point pitch.

Figure 6:
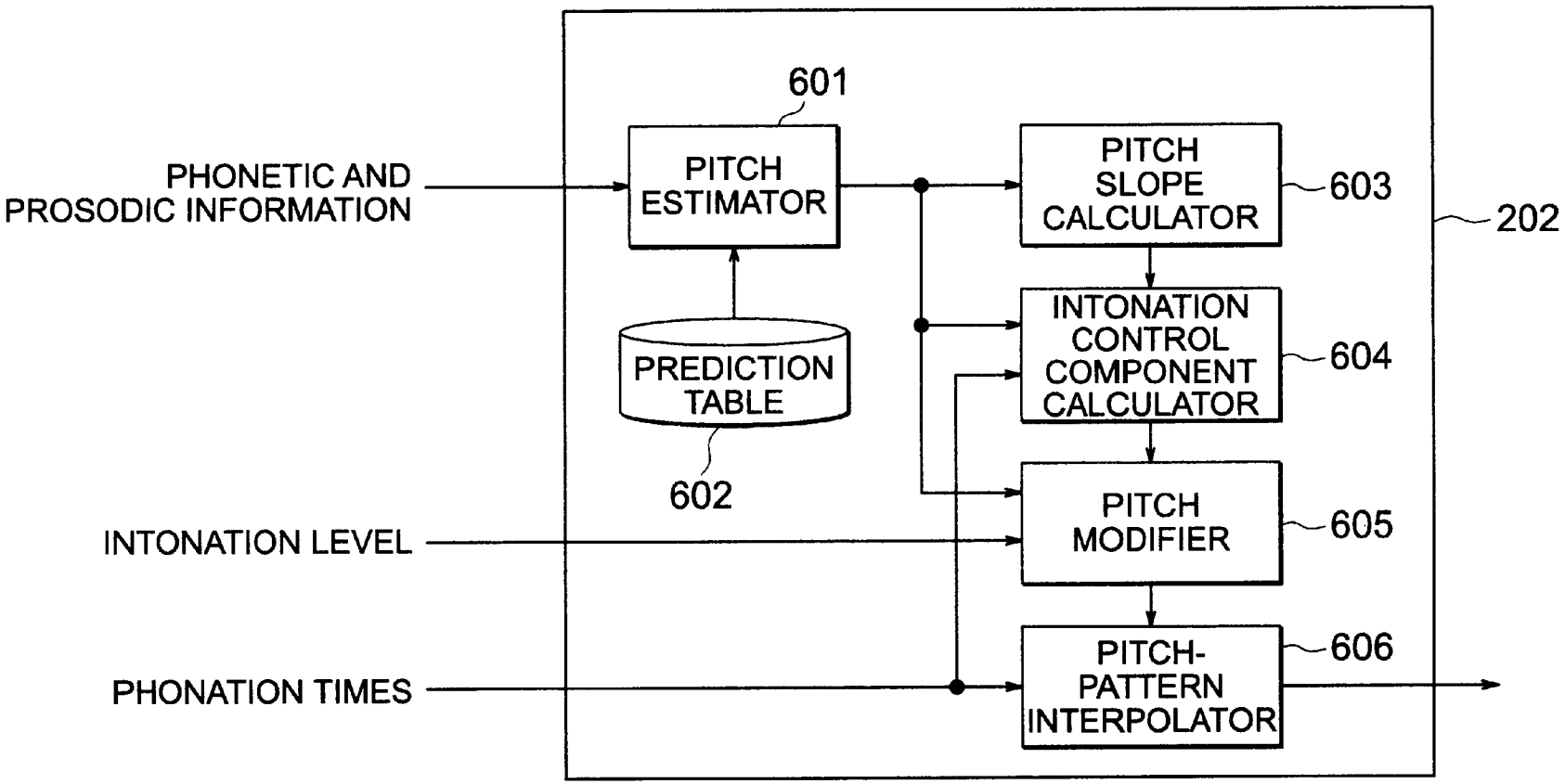
FIG. 6 is a block diagram of a first pitch pattern generator embodying the present invention.

FIG. 6 is a functional block diagram of the pitch pattern generator 202 in a first text-to-speech converter embodying the present invention. Differing from the conventional pitch pattern generator shown in FIG. 3, this pitch pattern generator calculates the pitch slope (pitch variation) from the first mora of a word to the last mora of the word, and relates intonation control to the pitch slope.

As in the prior art, the input to the pitch pattern generator 202 includes phonetic and prosodic information obtained from an intermediate language analyzer 201, phonation times determined by a phonation time generator 203, and user-designated intonation levels.

The phonetic and prosodic information is furnished to a pitch estimator 601, for use as control factors in the estimation of pitch. Pitch estimation is based on a statistical technique such as Hayashi's first quantification method. Control rules are determined from a speech data base including a large number of sample utterances by one or more speakers. The central vowel pitch of each mora is estimated by use of a pre-trained prediction table 602. A detailed description of Hayashi's first quantification method will be omitted, as this method is well known. The central vowel pitches output from the pitch estimator 601 form an original point pitch pattern that is supplied to a pitch slope calculator 603, an intonation control component calculator 604, and a pitch modifier 605.

The pitch slope calculator 603 divides the original point pitch pattern into words, calculates the difference between the first point pitch (the central vowel pitch of the first mora) and the last point pitch (the central vowel pitch of the last mora) in each word, and supplies the calculated difference to the intonation control component calculator 604.

The intonation control component calculator 604 receives the original point pitch pattern, the differences calculated by the pitch slope calculator 603, and the phonation times. From this information, the intonation control component calculator 604 finds a pitch slope line for each word, determines the intonation control component of each mora, and passes this information to the pitch modifier 605. In this embodiment, the intonation control component is the component of a point pitch disposed above the pitch slope line. The pitch slope line is a straight line joining the first point pitch of a word to the last point pitch of the word.

The pitch modifier 605 receives the original point pitch pattern, the calculated intonation control components, and the user-designated intonation levels. The pitch modifier 605 enlarges or reduces the intonation control components in a predetermined ratio corresponding to the designated intonation levels, thereby generating a modified point pitch pattern which is output to a pitch-pattern interpolator 606.

The pitch-pattern interpolator 606 receives the phonation times and the modified point pitch pattern, and performs linear interpolation or spline interpolation between the supplied point pitches to generate a pitch pattern, which is output to the synthesis parameter generator 206 in FIG. 2.

The operation of the first embodiment will now be described in more detail with reference to FIGS. 6 to 13. The description will be confined to the generation of the pitch pattern, this being the part that differs from the prior art.

First, phonetic and prosodic information is input from the intermediate language analyzer 201 (in FIG. 2) to the pitch estimator 601. When the information for one sentence has been input, central vowel pitches are estimated by a statistical technique such as Hayashi's first quantification method (details omitted). The estimation is carried out by use of the prediction table 602, which has been pre-trained from a large natural speech data base. When central vowel pitches have been estimated for the entire sentence, the resulting original point pitch pattern is supplied to the pitch slope calculator 603, the intonation control component calculator 604, and the pitch modifier 605. The supplied information is organized into word units, specifying, for example, the pitch of the m-th mora of the n-th word (m and n being non-negative integers).

Figure 7:
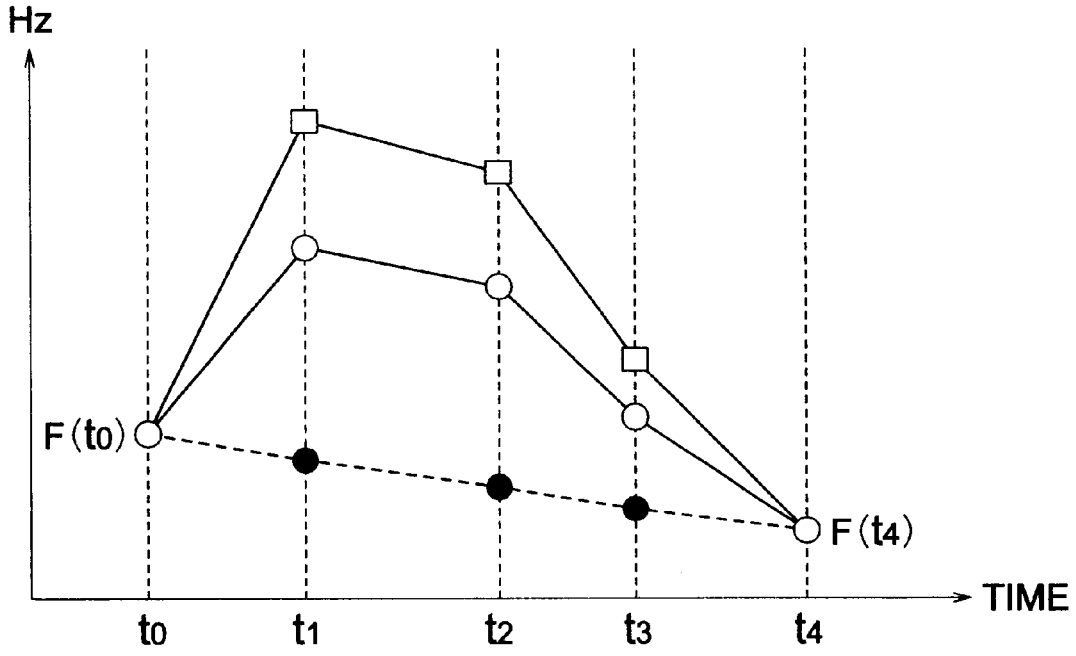
FIG. 7 illustrates modified and unmodified point pitch patterns and their pitch slope line.

For each word in the sentence, the pitch slope calculator 603 calculates the difference between the point pitches of the first mora and last mora of the word, and passes the calculated difference to the intonation control component calculator 604. An example is shown in FIG. 7, the vertical axis representing pitch frequency in hertz, the horizontal axis representing time. The white dots joined by a black line are the original point pitch pattern as estimated by the pitch estimator 601. In this example, vowel centers occur at times $t_0$, $t_1$, $t_2$, $t_3$, and $t_4$. If F(T) denotes the point pitch frequency at a time T, then the difference calculated by the pitch slope calculator 603 is $F(t_1)-F(t_4)$, and the straight line joining $F(t_0)$ to $F(t_4)$ is the pitch slope line. The black dots in FIG. 7 are located at times $t_1$, $t_2$, and $t_3$ on the pitch slope line, temporally matching the three intermediate point pitches $F(t_1)$, $F(t_2)$, and $F(t_3)$, all of which lie above the pitch slope line.

The intonation control component calculator 604 calculates the distances from these intermediate point pitches $F(t_1)$, $F(t_2)$, and $F(t_3)$ to the temporally matching points on the pitch slope line. That is, it finds the component of each intermediate point pitch that lies above the pitch slope line, this being the intonation control component. If $F_0(T)$ denotes the frequency value of a point on the pitch slope line at time T, then the intonation control component at time $t_1$, for example, is $F(t_1)-F_0(t_1)$ In FIG. 7, the region enclosed between the black line joining the white dots and the dotted line joining the black dots is the aggregate intonation control region. The phonation times of the constituent phonemes are needed for the calculation of the pitch slope line, so they are received from the phonation time generator 203 (shown in FIG. 2). This information is also organized into word units, giving, for example, the absolute time of the vowel center of the m-th mora in the n-th word. As the intonation control components are calculated, they are passed to the pitch modifier 605.

The intonation level designated by the user for each word is also passed to the pitch modifier 605, which increases or decreases the intonation control components according to the designated level. The user has, for example, a selection of three predetermined intonation levels: level one (x0.5), level two (x1.0), and level three (x1.5). The point pitches are modified by processing carried out according to these levels. In FIG. 7, the white squares joined by a black line indicate the modified point pitch pattern for x1.5-level intonation.

The pitch-pattern interpolator 606 carries out linear interpolation or spline interpolation between the point pitches, using the modified point pitch pattern and the phonation-time information. The result is supplied to the synthesis parameter generator 206 (in FIG. 2) as a pitch pattern.

Figure 8:
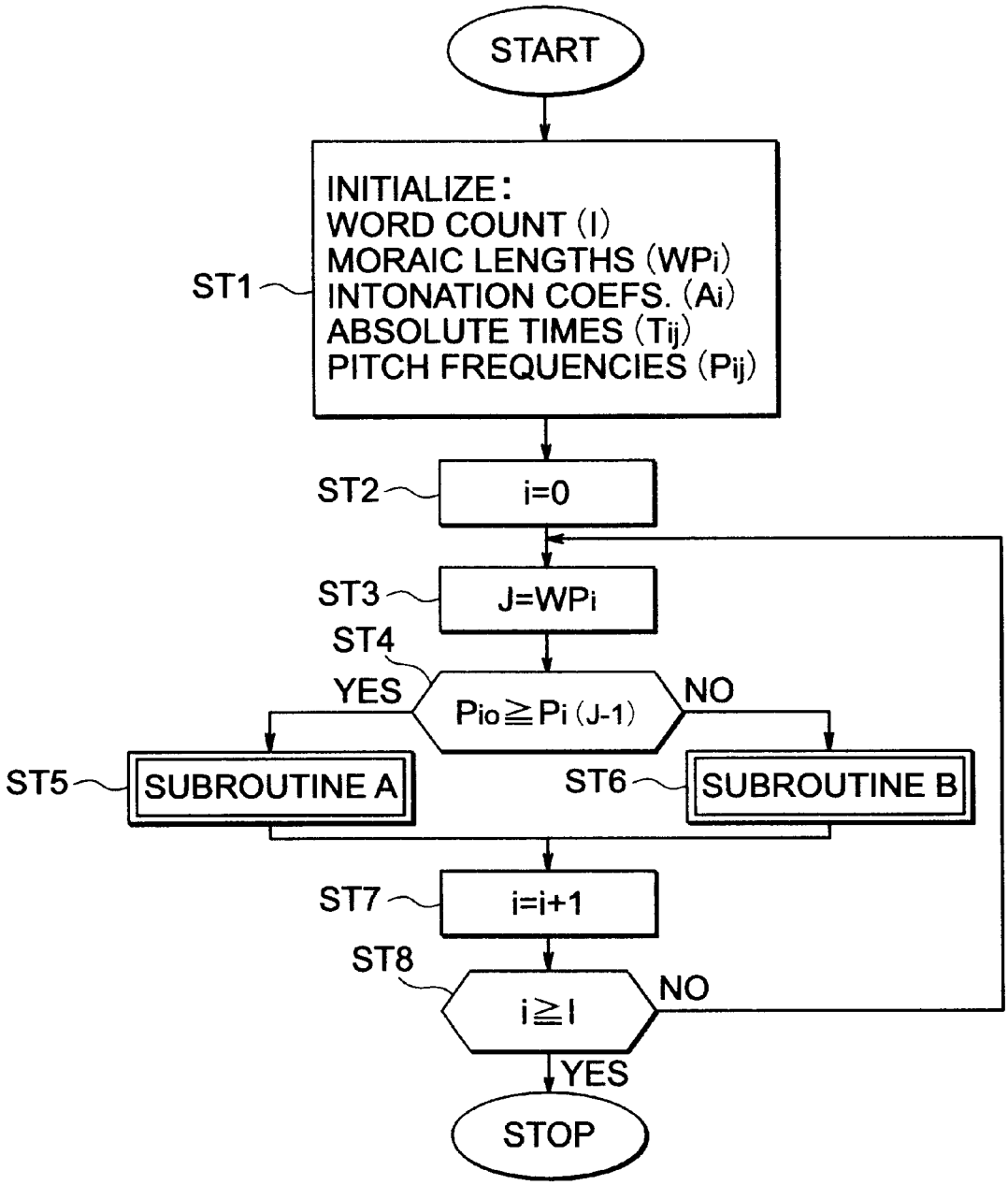
FIGS. 8, 9, and 10 are flowcharts describing the operation of the pitch pattern generator in FIG. 6.
Figure 9:
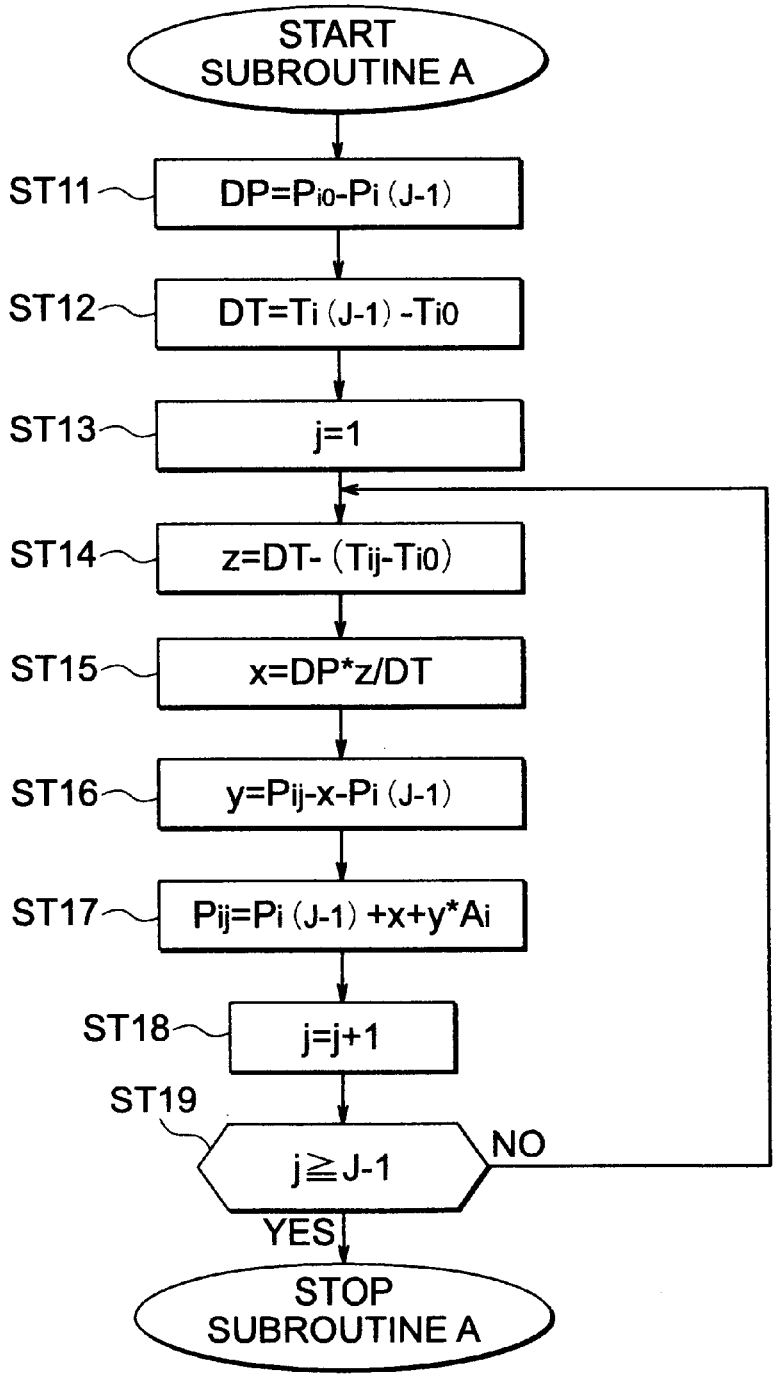
Figure 10:
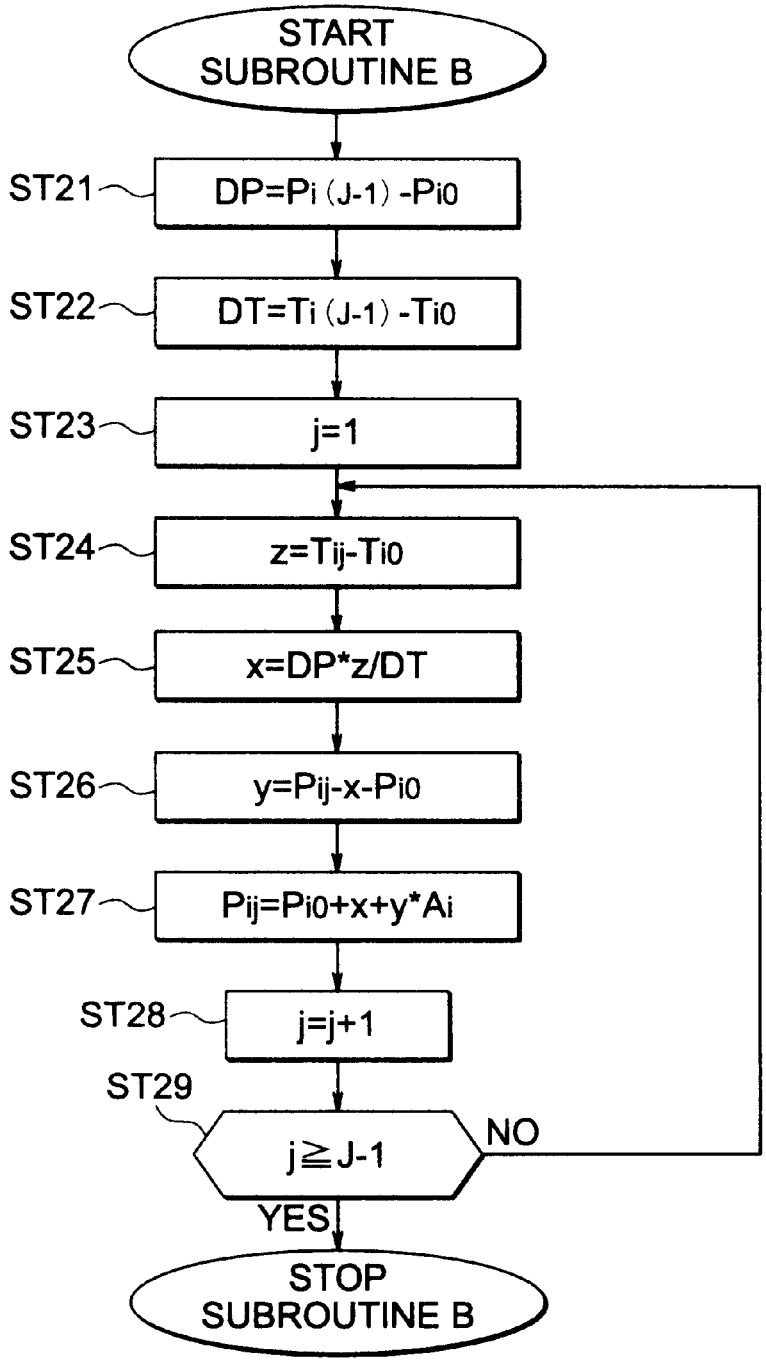

To describe this intonation control process more precisely, the process is depicted in flowcharts in FIGS. 8 to 10. These flowcharts show the processing carried out by the pitch slope calculator 603, intonation control component calculator 604, and pitch modifier 605 in FIG. 6.

First, in step STI in FIG. 8, the following parameters are initialized: the word count (number of words) of the input sentence (I), the moraic length (number of morae) in the i-th word ($WP_i$), the intonation control coefficient (Coef.) of the i-th word ($A_i$), the absolute time of the vowel center of the j-th mora in the i-th word (Tij), and the central vowel pitch frequency of the j-th mora in the i-th word ($P_{ij}$), where i and j are integers, i varying from zero to I−1, and j varying from zero to $WP_i$−1 in the i-th word. The intonation control coefficient $A_i$ is the multiplier corresponding to the intonation control level specified by the user, e.g., 1.5 for level three.

In step ST2, the word counter (i) is initialized to zero.

In step ST3, the moraic length of the i-th word is assigned to a variable J. This variable is used in subroutines that will be described below.

In steps ST4 to ST8, the intonation control process is carried out on the i-th word.

In step ST4, the central vowel pitches or point pitches of the first mora ($P_{i0}$) and the last mora ($P_{i(J-1)}$) are compared. The process proceeds to step ST5 if the first point pitch ($P_{i0}$) is at least as high as the last point pitch ($P_{i(J-1)}$), and to step ST6 otherwise.

In step ST5, a subroutine A, illustrated in FIG. 9, is executed. In step ST6, a subroutine B, illustrated in FIG. 10, is executed. These subroutines, which modify the point pitches of the i-th word, will be described later.

In step ST7, the word counter (i) is incremented by one. In step ST8, the word counter value is compared with the total number of words (I). If i is equal to or greater than I, the last word has been processed, so the process stops. Otherwise, the process returns to step ST3 to process the next word.

Subroutine A, which carries out pitch modifications when the point pitch of the first mora is at least as high as the point pitch of the last mora, will now be described with reference to FIG. 9. In step ST11, the difference between the first and last point pitches is calculated. This difference is the value of the first point pitch relative to the last point pitch. If the pitch difference is denoted DP, this relation is expressed by the following equation.

$$DP=P_{i0}-P_{i(J-1)} \tag{3}$$

In step ST12, the time (DT) from the vowel center of the first mora to the vowel center of the last mora is calculated as follows.

$$DT=T_{i(J-1)}-T_{i0} \tag{4}$$

In step ST13, a mora counter (j) is initialized. In the present embodiment, intonation control is not carried out on the first mora of the word, so the processing starts from the second mora (j=1) instead of the first mora (j=0).

In step ST14, the temporal difference (z) between the vowel centers of the current mora and the last mora is calculated. The calculation can be performed as follows.

$$z=DT-(T_{ij}-T_{i0}) \tag{5}$$

In step ST15, the slope component (x) of the current point pitch is calculated in relation to the last point pitch. This calculation can be performed as follows.

$$x=DP*z/DT \tag{6}$$

In step ST16, the intonation control component (y) of the current point pitch is calculated, this being the component exceeding the pitch slope line. This calculation can be performed as follows.

$$y=P_{ij}-x-P_{i(J-1)} \tag{7}$$

In step ST17, the current point pitch is modified according to the intonation control rule. Using the notation given above, the current point pitch ($P_{ij}$) is changed to the following value.

$$P_{ij}=P_{i(J-1)}+x+(y*A_i) \tag{8}$$

In step ST18, the mora counter (j) is incremented by one. In step ST19, a termination decision is made. In this embodiment, it is not necessary to process the last mora in the word, so the mora counter value is compared with the last mora number (J−1). If j is equal to or greater than the last mora number (J−1), the penultimate mora has been processed, so the subroutine stops. Otherwise, the process returns to step ST14.

Figure 11:
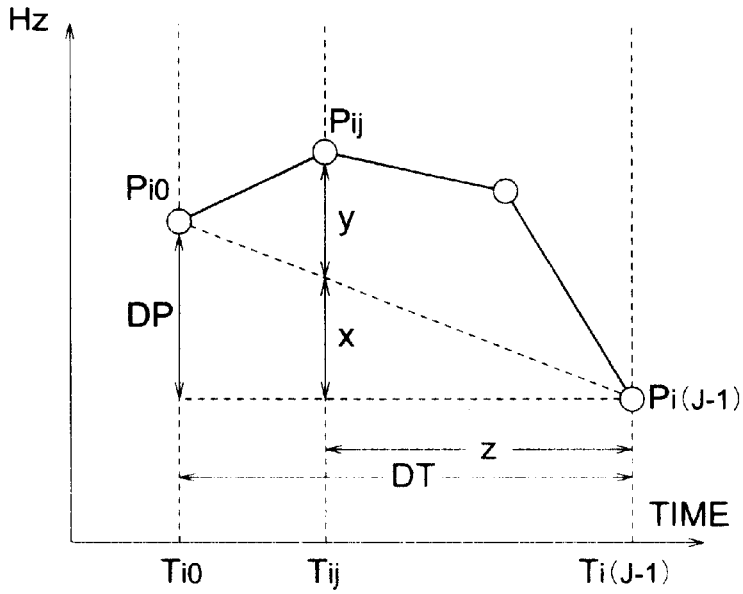
FIG. 11 illustrates the meaning of variables used in FIG. 9.

The meanings of the variables used in subroutine A are illustrated in FIG. 11.

Subroutine B, which carries out pitch modifications when the pitch of the first mora is lower than the pitch of the last mora, will be described with reference to FIG. 10. In step ST21, the pitch difference (DP) between the two ends of the pitch slope line is calculated. This pitch difference is the value of the last point pitch relative to the first point pitch. The calculation can be carried out as follows.

$$DP=P_{i(J-1)}-P_{i0} \tag{9}$$

In step ST22, the time (DT) from the first vowel center to the last vowel center is calculated as in subroutine A, using equation (4). In step ST23, the mora counter (j) is initialized to one, because intonation control is not carried out on the first mora of the word.

In step ST24, the temporal difference (z) between the vowel centers of the current mora and the first mora is calculated. The calculation can be performed as follows.

$$^{z}=(\mathrm{i}\ T_{ij}-T_{i0}) \tag{10}$$

In step ST25, the pitch (x) of a point on the pitch slope line temporally matching the current point pitch is calculated in relation to the last point pitch. The same equation (6) as in subroutine A can be used.

In step ST26, the intonation control component (y) of the current mora is calculated essentially as in subroutine A, using equation (7) but subtracting $P_{i0}$ instead of $P_{i(J-1)}$.

In step ST27, the pitch is modified according to the intonation control rule. The pitch of the current mora ($P_{ij}$) is now changed to the following value.

$$P_{ij}=P_{i0}+x+(y*A_i) \tag{11}$$

In step ST28, the mora counter (j) is incremented. In step ST29, a termination decision is made as in subroutine A, by comparing the mora counter value with the last mora number (J−1), because it is not necessary to process the last mora.

Figure 12:
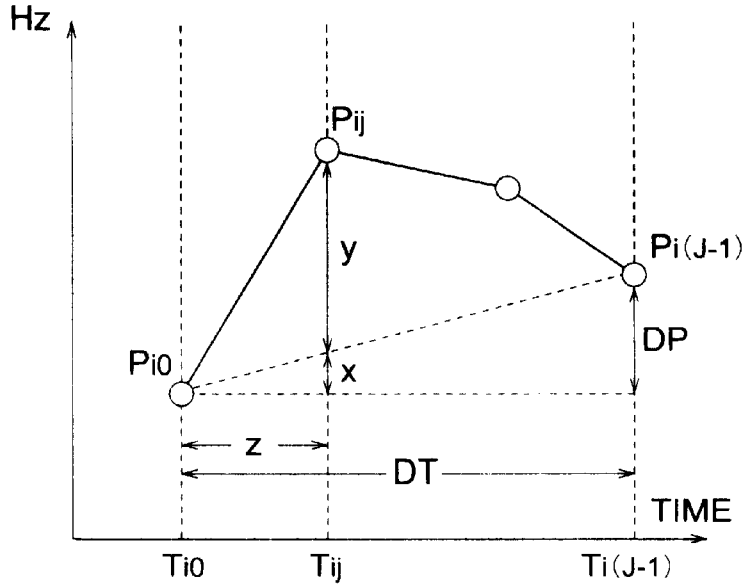
FIG. 12 illustrates the meaning of variables used in FIG. 10.

The meanings of the variables used in subroutine B are illustrated in FIG. 12.

In a variation of the present embodiment, subroutines A and B are combined into a single routine that, for example, calculates quantities w and y and modifies pitch $P_{ij}$ as follows. The quantity w is equal to $x+P_{i(J-1)}$ in FIG. 11, and to $x+P_{i0}$ in FIG. 12.

$$w = \{P_{i(J-1)} * (T_{ij} - T_{i0}) + P_{i0} * (T_{i(J-1)} - T_{ij})\} / (T_{i(J-1)} - T_{i0})$$

$$y = P_{ij} - w$$

$$P_{ij} = w + (y * A_i)$$

As described in detail above, the present embodiment joins the central vowel pitch of the first mora to the central vowel pitch of the last mora by a straight point slope line, and modifies only pitch components disposed above this line. The original point pitch pattern is generated so that no point pitches are disposed below the pitch slope line. The problem of extremely high pitches being produced near the start of a word for which strong intonation is specified, which occurred in the prior art, is prevented. In particular, the pitch of the first mora always remains fixed. The synthesized speech has a more natural sound than in the prior art.

Figure 13:
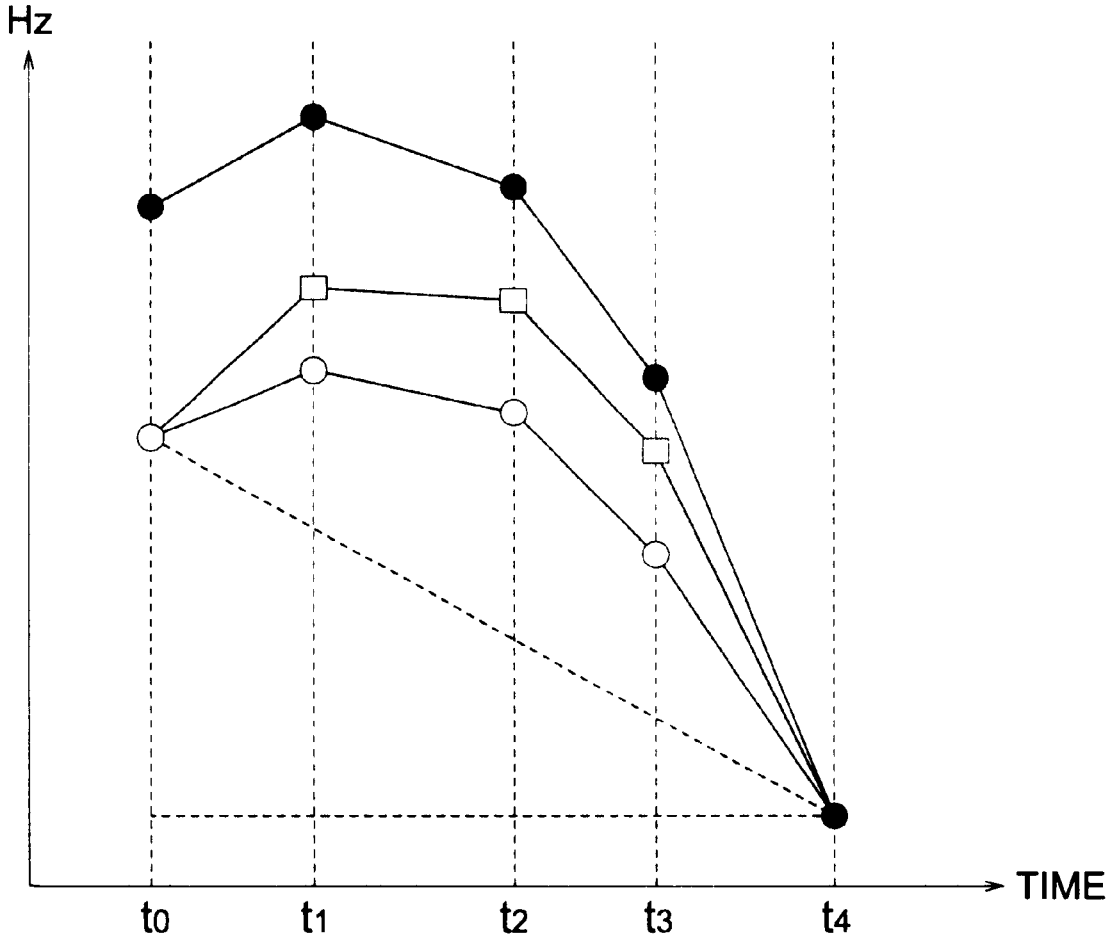
FIG. 13 compares pitch control performed by the conventional pitch pattern generator in FIG. 1 and the pitch pattern generator in FIG. 6.

As an example, FIG. 13 compares the point pitch patterns produced by x1.5 intonation control in the prior art and the present embodiment. The original point pitch pattern is indicated by white dots joined by a thick line. The modified point pitch pattern produced by the present embodiment is indicated by white squares joined by a thin line, and the modified point pitch pattern produced by the prior art is indicated by black dots joined by another thin line. When the final pitch is extremely low, the prior art produces extremely high pitches near the beginning of the word, e.g., at time $t_1$, while the first embodiment does not. In this example, the first embodiment generates an ideal point pitch pattern.

As noted above, the last word in a sentence tends to end on a very low pitch. The first embodiment therefore has the particular effect of preventing distorted intonation of the last word, which was a problem in the prior art.

In words with a type-one accent, however, in which the pitch of the very first mora is high, the pitch slope line used in the first embodiment may become too steep to produce the level of intonation control desired by the user. Furthermore, in words with a type-zero accent, which should have no distinct accent nucleus, if a high level of intonation control is specified, then while the last point pitch remains fixed, preceding point pitches may increase so much that an unintended accent is perceived. Thus the effectiveness of the first embodiment varies depending on the accent type.

The next embodiment has features that address this problem of variation with accent type, and also reduce variations in the overall voice pitch, which was an unwanted side-effect of conventional intonation control. This second embodiment, differing from the prior art, generates a simplified pitch pattern for each word and modifies the point pitches of each word on the basis of its simplified pitch pattern. Like the first embodiment, the second embodiment differs from the prior art only in regard to the pitch pattern generator, so the description will be confined to this element.

Figure 14:
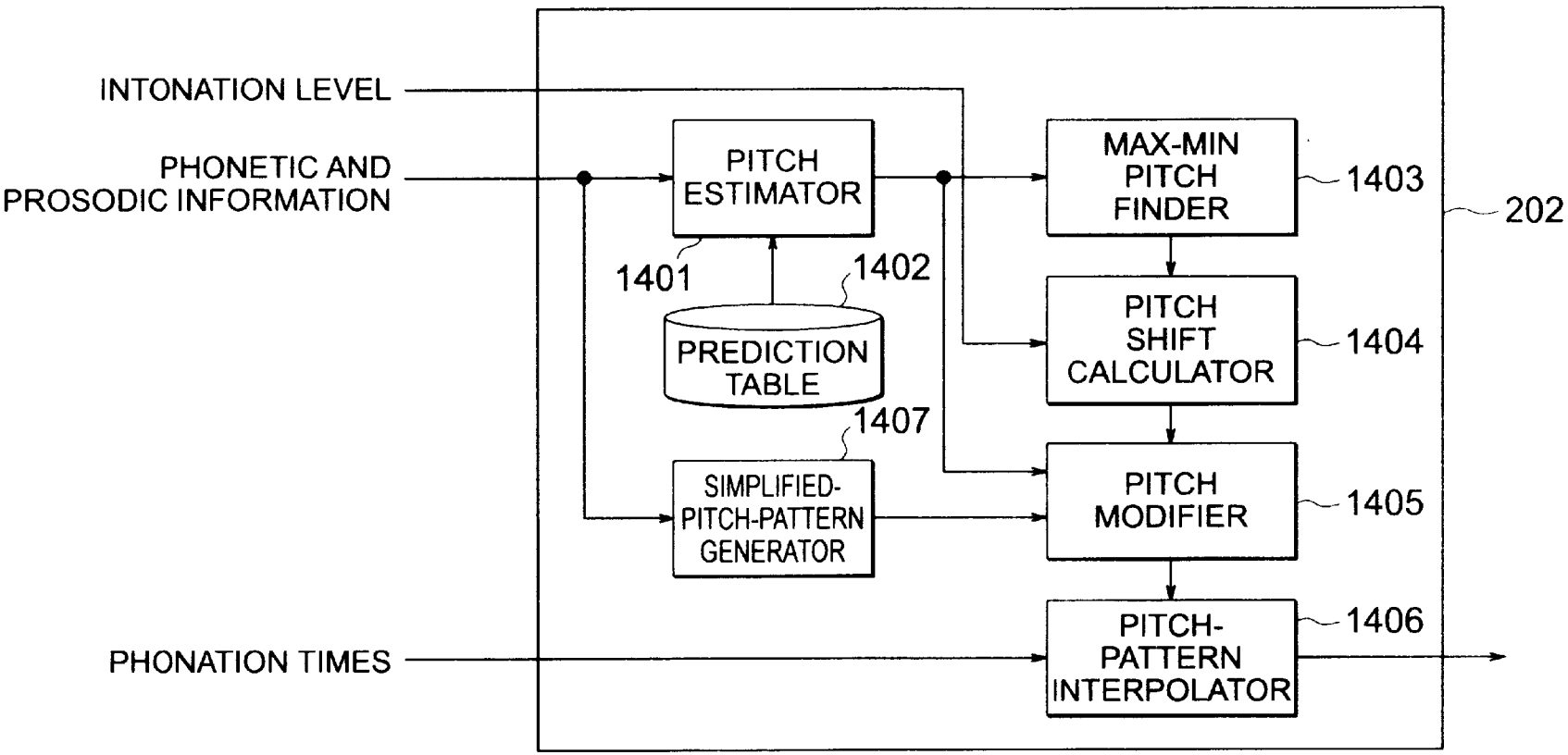
FIG. 14 is a block diagram of a second pitch pattern generator embodying the invention.

Referring to FIG. 14, in the second embodiment, as in the prior art, the input to the pitch pattern generator 202 includes phonetic and prosodic information obtained from the intermediate language analyzer 201 in FIG. 2, the phonation times determined by the phonation time generator 203 in FIG. 2, and user-designated intonation levels.

The phonetic and prosodic information is furnished to a pitch estimator 1401 and a simplified-pitch-pattern generator 1407. On the basis of this information, the pitch estimator 1401 derives point pitches as in the first embodiment and the prior art, using a pre-trained prediction table 1402 to estimate the central vowel pitch of each mora. A detailed description of the estimation procedure will be omitted. The central vowel pitches output from the pitch estimator 1401 form an original point pitch pattern that is supplied to a maximum-minimum (max-min) pitch finder 1403 and a pitch modifier 1405.

The maximum-minimum pitch finder 1403 divides the original point pitch pattern into words, finds the maximum point pitch and the minimum point pitch in each word, and supplies these pitch values to the pitch shift calculator 1404. The pitch shift calculator 1404 also receives the user-designated intonation levels.

For each word, the pitch shift calculator 1404 supplies the pitch modifier 1405 with the value of a pitch shift, calculated from the received maximum point pitch, minimum point pitch, and intonation level, for use in modifying the point pitches in the word. The simplified-pitch-pattern generator 1407 receives the phonetic and prosodic information from the intermediate language analyzer 201, creates a simplified pitch pattern in which the central vowel pitch of each mora is classified as either high or low, and supplies the simplified pitch pattern to the pitch modifier 1405.

The pitch modifier 1405 receives the simplified pitch pattern from the simplified-pitch-pattern generator 1407, the original point pitch pattern from the pitch estimator 1401, and the pitch shift from the pitch shift calculator 1404, modifies the point pitches on the basis the received information, and supplies the results to the pitch-pattern interpolator 1406.

The pitch-pattern interpolator 1406 receives the phonation times and the modified point pitch pattern, and performs linear interpolation or spline interpolation between the supplied point pitches to generate a pitch pattern, which is output to the synthesis parameter generator 206 in FIG. 2.

The operation of the second embodiment will now be described in more detail with reference to FIGS. 14 to 19. The description will be confined to the generation of the pitch pattern, which is the part that differs from the prior art.

First, phonetic and prosodic information is input from the intermediate language analyzer 201 (in FIG. 2) to the pitch estimator 1401. When the information for one sentence has been input, central vowel pitches are estimated by a statistical technique such as Hayashi's first quantification method (details omitted), using the prediction table 1402, which has been pre-trained from a large natural speech data base. When central vowel pitches have been estimated for all morae in one sentence, the resulting original point pitch pattern is supplied to the maximum-minimum pitch finder 1403 and the pitch modifier 1405. The supplied information is organized into word units, specifying, for example, the pitch of the m-th mora of the n-th word (m and n being non-negative integers).

For each given word, the maximum-minimum pitch finder 1403 finds the maximum point pitch and minimum point pitch in the word, and sends the resulting pitch frequency data to the pitch shift calculator 1404.

The pitch shift calculator 1404 takes the difference between the maximum and minimum point pitches, multiplies the difference by a coefficient corresponding to the user-designated intonation level to obtain the pitch shift, and passes the pitch shift to the pitch modifier 1405. The user has, for example, a selection of three predetermined intonation levels, designated in this and subsequent embodiments as level one (x1.5), level two (x1.0), and level three (x0.5). In this embodiment, the values of the corresponding coefficients are one-half (0.5) for level one, zero (0) for level two, and minus one-half (−0.5) for level three.

The simplified-pitch-pattern generator 1407, like the pitch estimator 1401, receives the phonetic information and prosodic information supplied by the intermediate language analyzer 201. The simplified-pitch-pattern generator 1407 classifies each point pitch as either high or low and sends a simplified pitch pattern representing these binary pitch classifications to the pitch modifier 1405. The simplified pitch pattern is determined basically by the accent type of the word: low-high-high-high- . . . for a word with a type-zero accent; high-low-low-low- . . . for a word with a type-one accent; and for other accent types, a pattern starting with a low-high transition and reverting to low on the mora following the accent nucleus. When the second point pitch represents a dependent sound, however, and the accent type is not type one, the first point pitch is classified as high. A dependent sound is a sound that depends on the sound represented by the preceding point pitch, in this case the sound represented by the first point pitch.

The pitch modifier 1405 modifies the point pitch pattern by adding the pitch shift received from the pitch shift calculator 1404 to point pitches classified as high in the simplified pitch pattern, and subtracting the pitch shift received from the pitch shift calculator 1404 from point pitches classified as low in the simplified pitch pattern. The modified point pitch pattern is output to the pitch-pattern interpolator 1406.

The pitch-pattern interpolator 1406 receives the phonation times and the modified point pitch pattern, and performs linear interpolation or spline interpolation between the supplied point pitches to generate a pitch pattern, which is output to the synthesis parameter generator 206 in FIG. 2.

Figure 15:
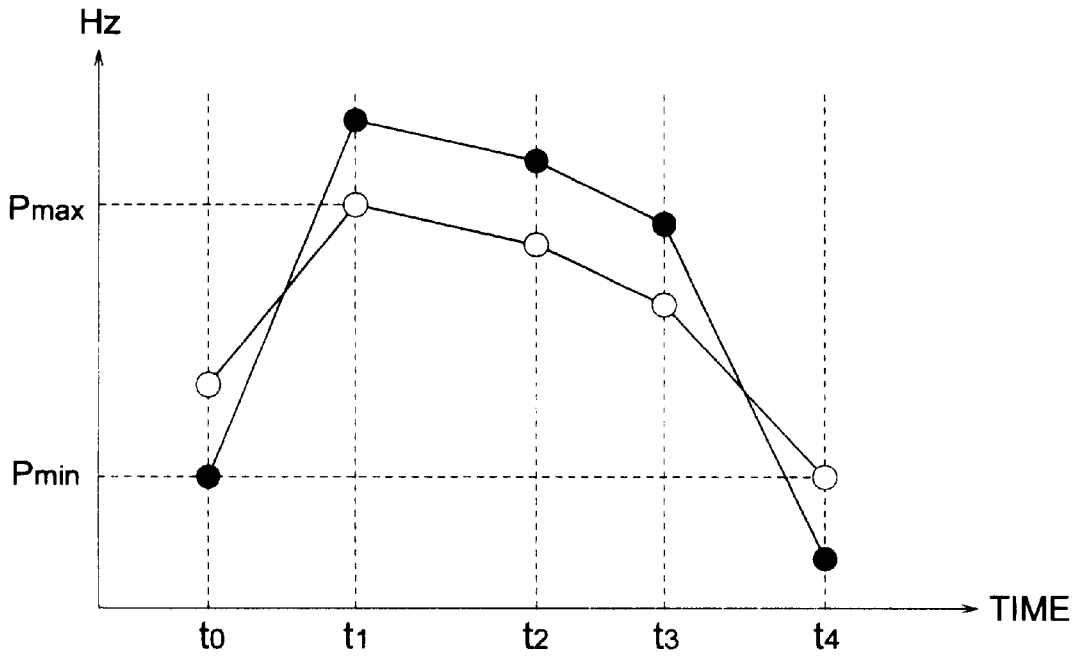
FIG. 15 illustrates pitch control performed by the pitch pattern generator in FIG. 14.

FIG. 15 shows an example of the processing performed in the present embodiment. The word illustrated has five morae and a type-four accent. Level-one (x1.5) intonation control is specified. The white dots represent the original point pitch pattern. The black dots represent the modified point pitch pattern. The simplified pitch pattern of this word is low-high-high-high-low.

The amount of intonation in this example is increased by half (0.5), but because high pitches are raised and low pitches are lowered, the actual amount by which each pitch is shifted is one-quarter (0.25) of the intonation component. The intonation component referred to here is the difference between the maximum pitch ($P_{max}$), which occurs in the second mora at time $t_1$, and the minimum pitch ($P_{min}$), which occurs in the fifth mora at time $t_4$. Thus while intonation control changes this difference by one-half (0.5), the magnitude of the pitch shifts is:

$$(P_{max}-P_{min})*0.25$$

The point pitch of the first mora ($t_0$) is classified as low in the simplified pitch pattern, so the above value is subtracted from its pitch. The point pitch of the second mora ($t_1$) is classified as high in the simplified pitch pattern, so the above value its added to its pitch. Modifications continue in this way through the final mora.

Figure 16:
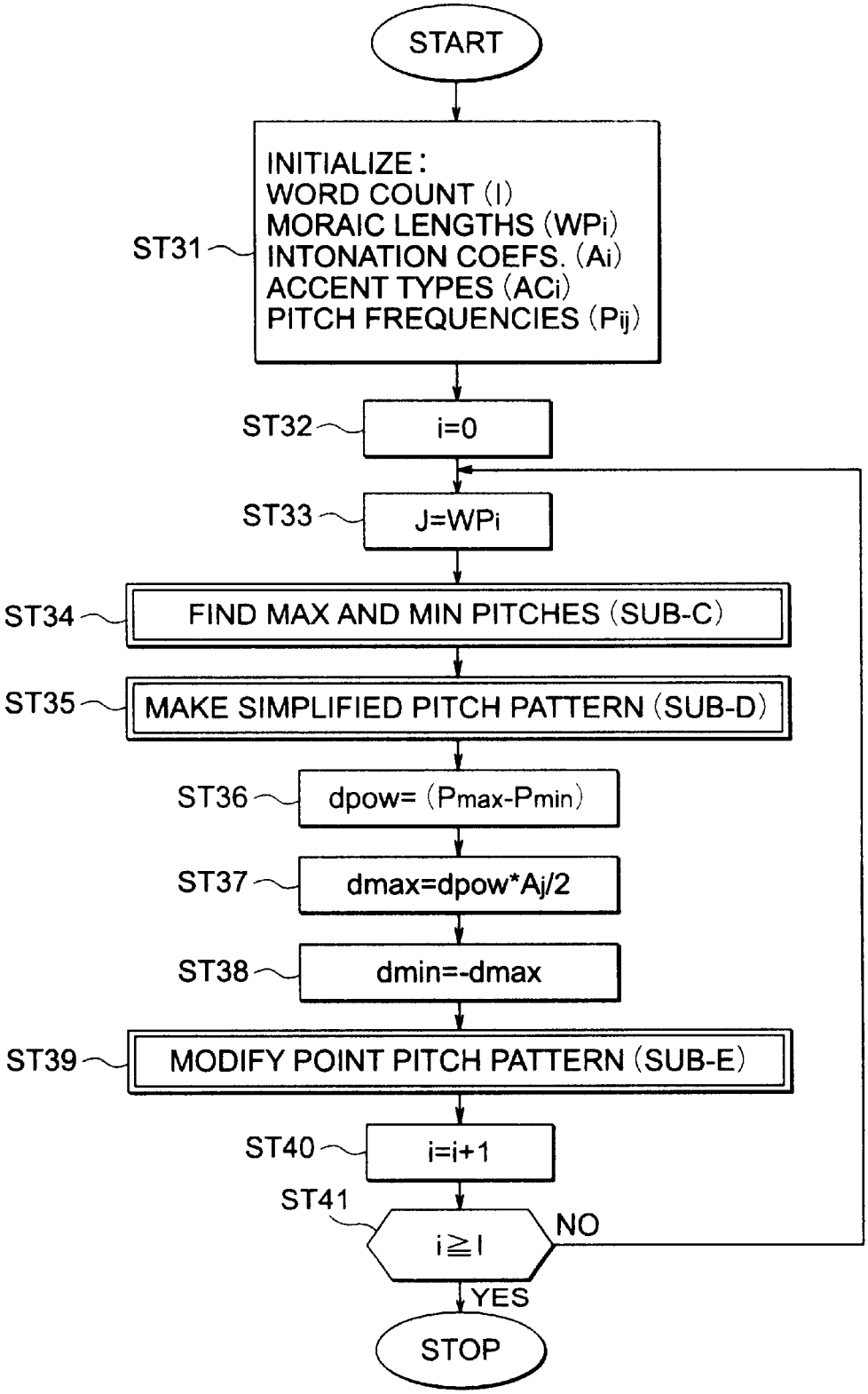
FIGS. 16, 17, 18, and 19 are flowcharts describing the operation of the pitch pattern generator in FIG. 14.

To describe this intonation control process more precisely, the process is depicted in flowcharts in FIGS. 16 to 19. These flowcharts show the processing carried out by the simplified-pitch-pattern generator 1407, maximum-minimum pitch finder 1403, pitch shift calculator 1404, and pitch modifier 1405 in FIG. 14. The flow of the processing of a word is shown in FIG. 16.

First, in step ST31 in FIG. 16, the following parameters are initialized: the word count of the input sentence (I), the moraic length of the i-th word ($WP_i$), the intonation control coefficient of the i-th word ($A_i$), the accent type of the i-th word ($AC_i$), and the central vowel pitch frequency of the j-th mora in the i-th word ($P_{ij}$), where i and j are integers as described in the first embodiment.

In step ST32, the word counter (i) is initialized to zero.

In step ST33, the moraic length of the i-th word is assigned to a variable J.

In steps ST34 to ST40, the intonation control process is carried out on the i-th word.

Figure 17:
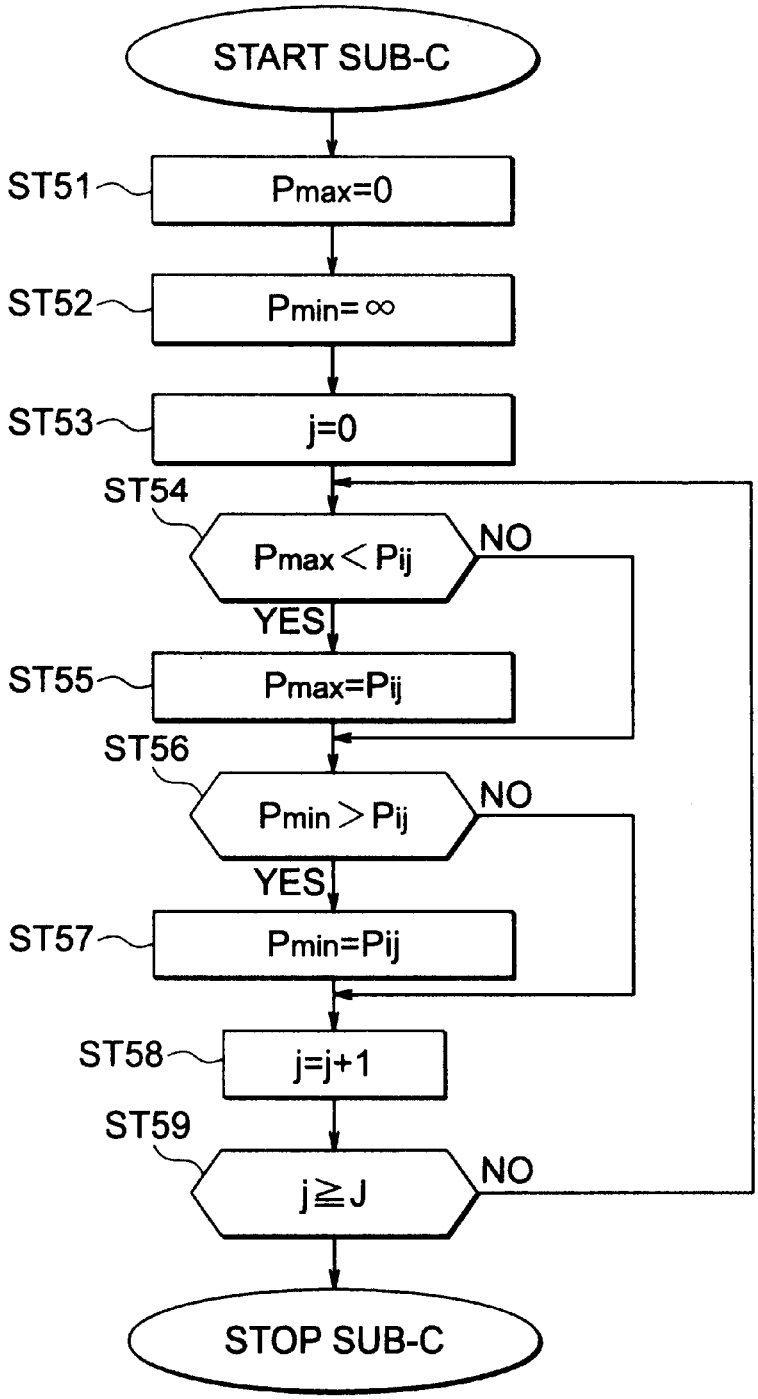

First, the maximum point pitch $P_{max}$ and minimum point pitch $P_{min}$ are found in step ST34. This process is illustrated in FIG. 17 and will be described later.

Figure 18:
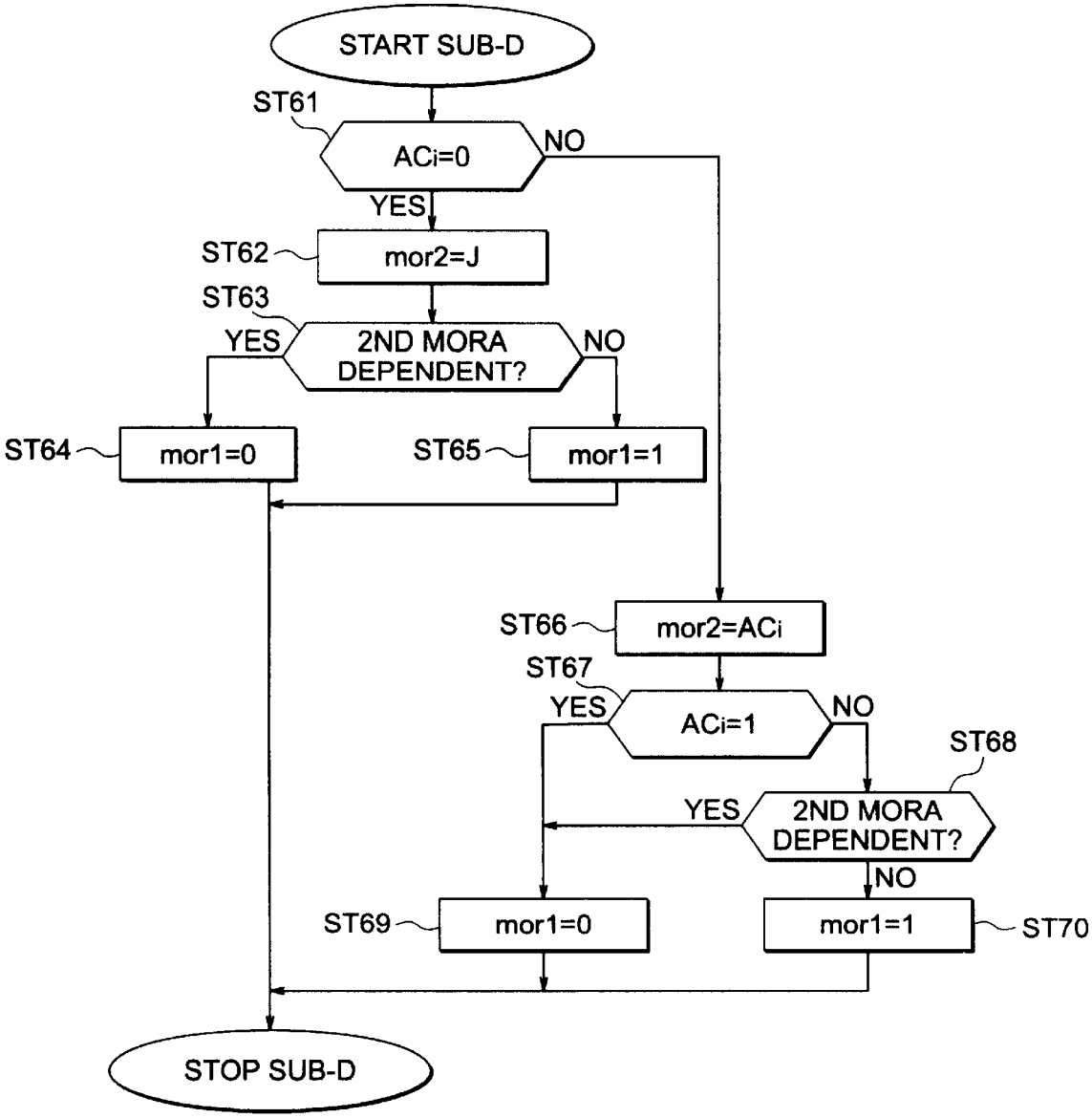

In step ST35, the simplified pitch pattern of the i-th word is generated from the accent type and moraic length of the word. This process is illustrated in FIG. 18 and will be described later.

In step ST36, the difference (dpow) between the maximum point pitch $P_{max}$ and minimum point pitch $P_{min}$ is calculated.

In step ST37, a high pitch shift (dmax) to be added to high pitches is calculated as follows.

$$dmax=dpow*A_i/2 \tag{12}$$

$A_i$ is the predetermined intonation control coefficient corresponding to the intonation level designated by the user for the i-th word. In the example given above, $A_i$ has the following values.

$$\textit{Level } 1\ (x1.5\ \textit{intonation})\quad A_i = 0.5$$

$$\textit{Level } 2\ (x1.0\ \textit{intonation})\quad A_i = 0$$

$$\textit{Level } 3\ (x0.5\ \textit{intonation})\quad A_i = -0.5$$

In step ST38, a low pitch shift (dmin) to be added to low pitches is calculated as follows.

$$dmin=-dmax \tag{13}$$

Figure 19:
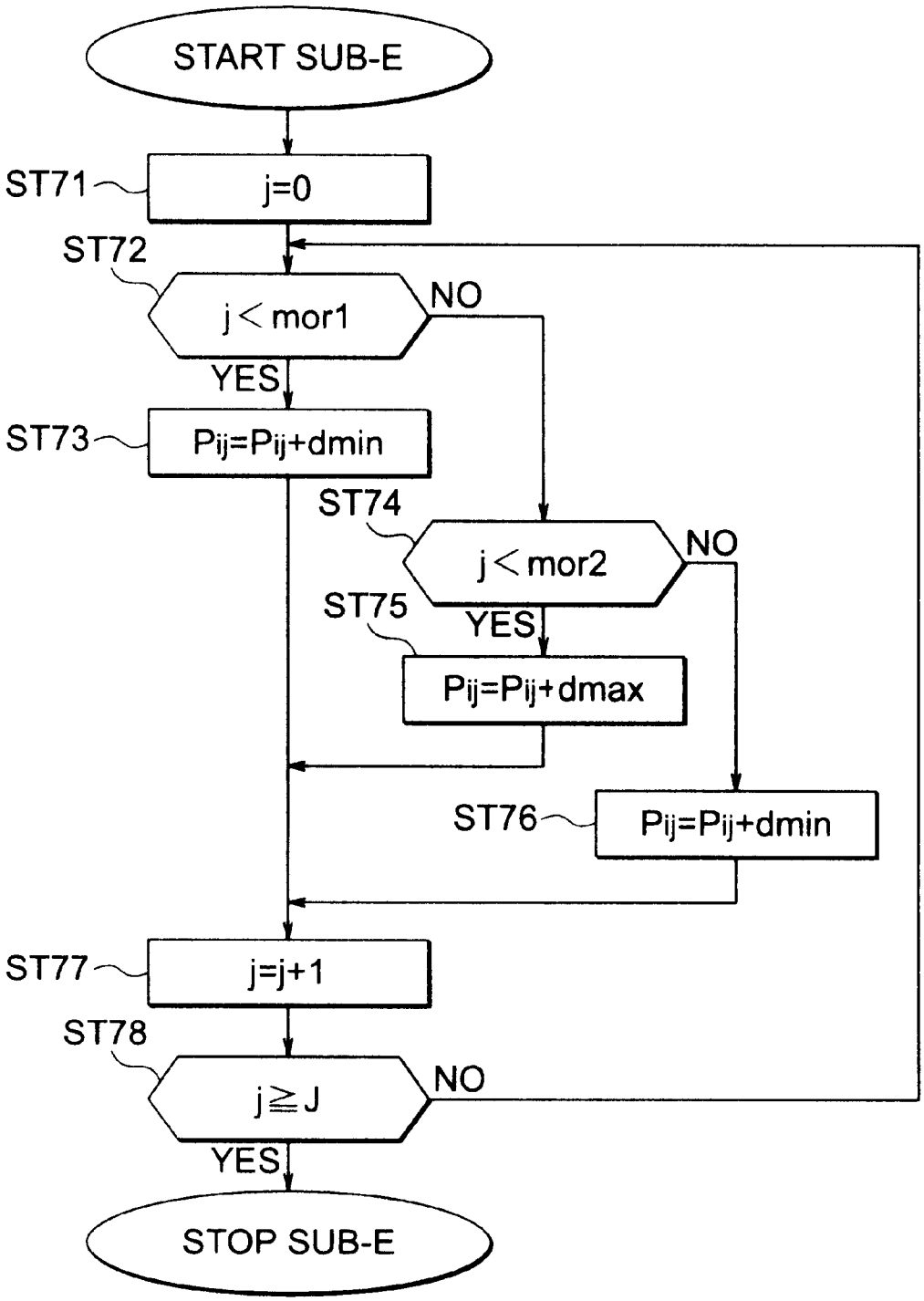

In step ST39, dmax and dmin are used to modify the point pitches. This step is illustrated in FIG. 19 and will be described later. When the modifications are completed, the word counter (i) is incremented in step ST40 and compared with the total number of words (I) in step ST41. If i is equal to or greater than I, the last word has been processed, so the process stops. Otherwise, the process returns to step ST33 to modify the point pitch pattern of the next word.

A subroutine C (sub-C), which finds the maximum and minimum pitches in step ST34, will now be described with reference to FIG. 17.

First, the maximum pitch $P_{max}$ is initialized to zero (0) in step ST51, the minimum pitch $P_{min}$ is initialized to an essentially infinite value (a value exceeding the largest possible pitch frequency) in step ST52, and the mora counter (j) is initialized to zero (0) in step ST53.

In step ST54, the central vowel pitch of the j-th mora ($P_{ij}$) is compared with the maximum pitch $P_{max}$. If $P_{ij}$ is greater than $P_{max}$, then $P_{max}$ is increased to $P_{ij}$ in step ST55. Otherwise, the process proceeds to step ST56.

In step ST56, the central vowel pitch of the j-th mora ($P_{ij}$) is compared with the minimum pitch Pmin. If $P_{ij}$ is less than $P_{min}$, then $P_{min}$ is reduced to $P_{ij}$ in step ST57. Otherwise, the process proceeds to step ST58.

The mora counter (j) is incremented in step ST58 and compared with the moraic length of the word (J) in step ST59. If j is equal to or greater than J, the last mora has been processed, so the subroutine ends. Otherwise, the subroutine returns to step ST54.

Next a subroutine D (sub-D), which generates the simplified pitch pattern in step ST35, will be described with reference to FIG. 18. As explained above, the simplified pitch pattern is a binary pitch pattern in which each point pitch is classified as high or low. The purpose of subroutine D is to calculate the moraic position at which the transition from low to high pitch occurs, and the moraic position at which the transition from high to low pitch occurs. These positions will be referred to below as the low-to-high transitional position (mor1) and the high-to-low transitional position (mor2).

In step ST61, the accent type ($AC_i$) is tested. The subroutine proceeds to step ST62 if the accent type is zero, and to step ST66 otherwise.

Steps ST62 to ST65 generate the simplified pitch pattern for a word with a type-zero accent. First, the high-to-low transitional position (mor2) is set to the moraic length of the word (J) in step ST62, because a type-zero accent has no accent nucleus.

In step ST63, the second mora of the word is tested. If the second mora is a dependent sound (the second part of a long vowel, or a dependent vowel or nasal /n/), the subroutine proceeds to step ST64; otherwise, it proceeds to step ST65. The low-to-high transitional position (mor1) is set to zero in step ST64, and to one in step ST65. The reason for step ST64 is that in this case the first mora and second mora have a strong tendency to be pronounced as a single mora, with a flat transition between them that raises the pitch of the first mora.

The remaining steps generate simplified pitch patterns for words with non-zero accent types. The high-to-low transitional position (mor2) is set to the value of the accent type ($AC_i$) in step ST66, and the accent type is tested in step ST67. If the accent type is one, the subroutine proceeds to step ST69 to set the low-to-high transitional position (mor1) to zero. Otherwise, the subroutine proceeds to step ST68 to test the second mora. If the second mora is a dependent sound, the subroutine proceeds from step ST68 to step ST69 and sets the low-to-high transitional position (mor1) to zero. Otherwise, the subroutine proceeds to step ST70 and sets mor1 to one. The setting of the transitional positions (mor1 and mor2) completes the generation of the simplified pitch pattern.

A subroutine E (sub-E), which modifies the point pitch pattern in step ST39, will be described next with reference to FIG. 19. First, in step ST71, the mora counter (j) is initialized to zero. The mora counter (j) is compared with the low-to-high transitional position (mor1) in step ST72. If this position (mor1) has not yet been reached, the current mora has a low pitch and the subroutine proceeds to step ST73. Otherwise, the subroutine proceeds to step ST74.

In step ST73, the pitch of the current mora is shifted by adding the low pitch shift as follows.

$$P_{ij}=P_{ij}+dmin \tag{14}$$

In step ST74, the mora counter (j) is compared with the high-to-low transitional position (mor2). If this position (mor2) has not yet been reached, then the current mora has a high pitch and the subroutine proceeds to step ST75. Otherwise, the subroutine proceeds to step ST76.

In step ST75, the pitch of the current mora is shifted by adding the high pitch shift as follows.

$$P_{ij}=P_{ij}+dmax \tag{15}$$

In step ST76, since the current mora has a low pitch, it is shifted as in step ST73, using equation (14).

After these steps, the mora counter (j) is incremented in step ST77 and compared with the moraic length of the word (J) in step ST78. If j is equal to or greater than J, the last mora has been processed, so the subroutine ends. Otherwise, the subroutine returns to step ST72 to process the next mora.

Since the high pitch shift and low pitch shift have equal magnitude and opposite sign, adding the low pitch is equivalent to subtracting the high pitch shift. Thus the description of the pitch modifier 1405 as adding a pitch shift to high point pitches and subtracting the same pitch shift from low pitches is consistent with FIG. 19.

As described above, the second embodiment divides the point pitch pattern of a word into high and low pitches. To increase the intonation, this embodiment shifts high pitches up and low pitches down by equal amounts. To decrease the intonation, this embodiment shifts high pitches down and low pitches up by equal amounts. Accordingly, the average pitch of the word is left substantially unchanged. More precisely, even if a change occurs in the average pitch, the change is less than half as much as it was in the prior art. Furthermore, accurate intonation control is achieved for words of all accent types, which was not possible in the prior art. The resulting synthesized speech is substantially free of unusual effects and is easy to listen to.

By adding a (positive or negative) shift to high point pitches and subtracting the same shift from low point pitches, however, the second embodiment fails to leave the average pitch always unchanged, because the number of high point pitches is not necessarily equal to the number of low point pitches. In some cases the change in average pitch becomes noticeable. For example, the user may specify a high intonation level for all words in a sentence, thereby using a feature that was intended to draw attention to a particular word or phrase to express an emotional change instead. Specifically, the user may increase the intonation level to give the synthesized speech a brighter or more lively sound. Alternatively, the user may reduce the intonation level to produce a darker or less lively sound. As a result, the average voice pitch of the entire sentence may be raised or lowered to some extent, which is an unwanted side-effect.

This side-effect is even more prominent in the prior art, where increasing or decreasing the intonation level always raises or lowers the average pitch. In the prior art it is necessary to compensate by specifying a voice pitch different from the desired pitch, but the compensation is not necessarily perfect. The third embodiment, described next, is particularly effective in countering this problem, because it always leaves a certain average pitch unchanged.

The third embodiment differs from the prior art by including both a pre-trained prediction table and an average pitch table. For each voice type represented in the prediction table, the average pitch table indicates the average speech pitch of the speech samples on which the prediction data of that voice type are based. Point pitches are modified in relation to this average speech pitch, so that pitches equal to the average speech pitch are left invariant. Accordingly, intonation control does not change the overall voice pitch.

Figure 20:
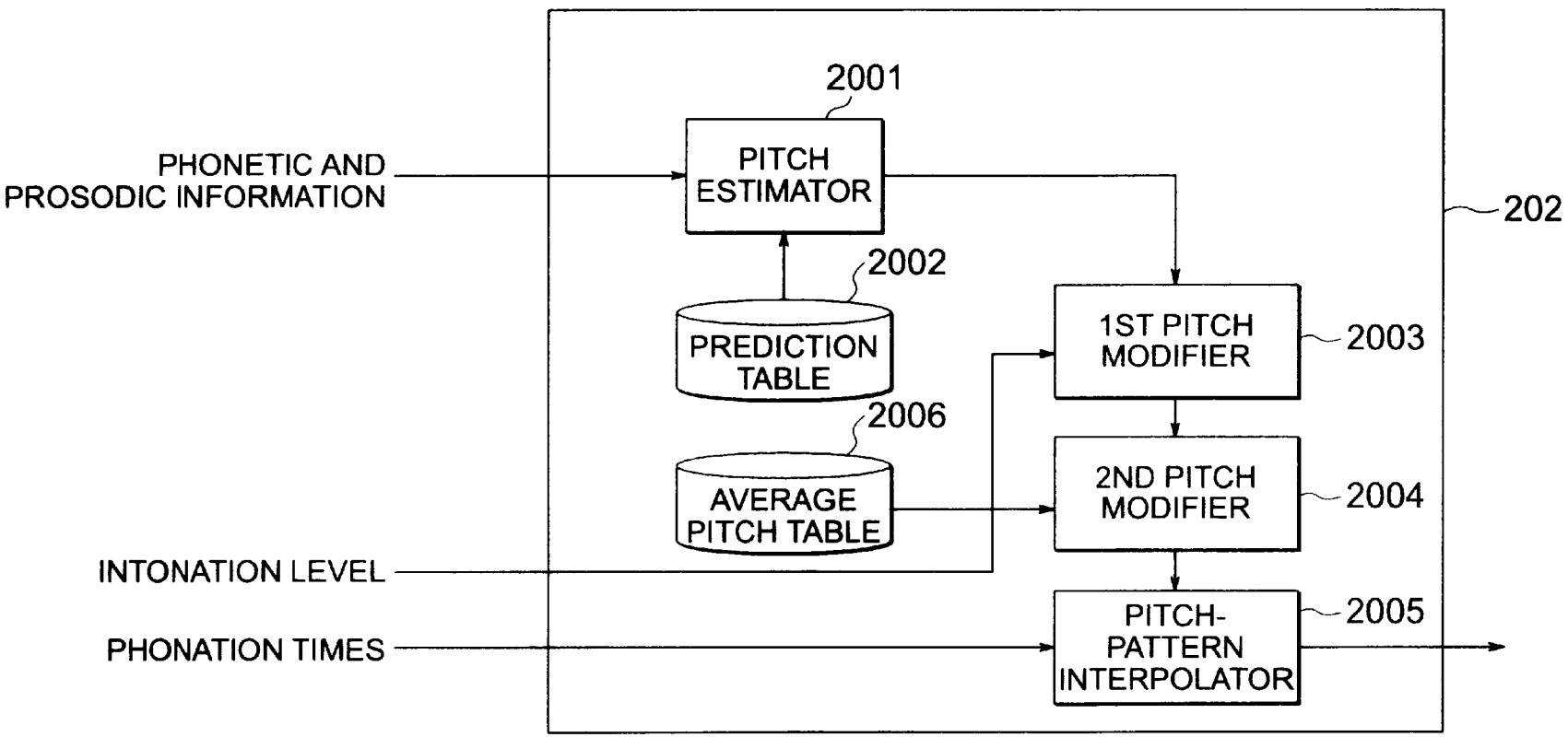
FIG. 20 is a block diagram of a third pitch pattern generator embodying the invention.

Referring to FIG. 20, in the third embodiment, as in the prior art, the input to the pitch pattern generator 202 includes phonetic and prosodic information obtained from the intermediate language analyzer 201 in FIG. 2, the phonation time of each phoneme as determined by the phonation time generator 203, and user-designated intonation levels. The pitch pattern generator 202 also receives a voice type designation (not visible) supplied by the user.

The phonetic and prosodic information is input to a pitch estimator 2001, which estimates point pitches as in the preceding embodiments and the prior art, using the supplied information and a pre-trained prediction table 2002. A detailed description of the pitch estimation process will again be omitted. The central vowel pitches output from the pitch estimator 2001 form an original point pitch pattern that is passed to a first pitch modifier 2003.

The first pitch modifier 2003 also receives the intonation levels specified by the user. The first pitch modifier 2003 modifies the original point pitch pattern by multiplying a component of the point pitches by a predetermined coefficient corresponding to the designated intonation level. Differing from the prior art, this component is referenced to a fixed base pitch frequency, instead of being referenced to the minimum pitch frequency in the current word. The resulting modified point pitch pattern is passed to a second pitch modifier 2004.

The second pitch modifier 2004 receives an average pitch value or invariant pitch from the average pitch table 2006, in addition to receiving the modified point pitch pattern generated by the first pitch modifier 2003. The average pitch table 2006 is derived from the same speech data as the prediction table 2002. As explained above, the average voice pitch of each speaker whose voice was used in training the prediction table 2002 is calculated, and these average pitch values are stored in the average pitch table 2006. The average pitch corresponding to the voice type designated by the user is read out to the second pitch modifier 2004. The second pitch modifier 2004 uses this average pitch to make a second modification of the point pitch pattern received from the first pitch modifier 2003, and supplies the result to a pitch-pattern interpolator 2005.

The pitch-pattern interpolator 2005, which also receives the input phonation times, performs linear interpolation or spline interpolation between the supplied point pitches to generate a pitch pattern, which is output to the synthesis parameter generator 206 in FIG. 2.

The operation of the third embodiment will be described in more detail with reference to FIGS. 20 to 22. The description will be confined to the generation of the pitch pattern, which is the part that differs from the prior art.

First, phonetic and prosodic information is input from the intermediate language analyzer 201 (in FIG. 2) to the pitch estimator 2001. When the information for one sentence has been input, central vowel pitches are estimated by a statistical technique such as Hayashi's first quantification method (details omitted), using the prediction table 2002, which has been pre-trained from a large natural speech data base. When central vowel pitches have been estimated for all morae in one sentence, the resulting original point pitch pattern is supplied to the first pitch modifier 2003. The supplied information is organized into word units, specifying, for example, the pitch of the m-th mora of the n-th word (m and n being non-negative integers).

The user-designated intonation level input to the first pitch modifier 2003 is, for example, one of three predetermined levels: level one (x1.5), level two (x1.0) and level three (x0.5). The first pitch modifier 2003 recalculates the point pitch of each mora in a given word, relative to a fixed base pitch, and increases or decreases the calculated relative pitch according to the designated intonation level. The fixed base pitch is the lowest pitch that can be synthesized: thirty hertz (30 Hz), for example. The modified point pitch pattern is then passed to the second pitch modifier 2004 for further modification.

The second pitch modifier 2004 receives the average speech pitch of the designated voice type from the average pitch table 2006, and carries out a uniform adjustment of the modified point pitches received from the first pitch modifier 2003. The average speech pitch is stored in the average pitch table 2006 as an average value relative to the base pitch, calculated from the average of the sample data used in the training of the prediction table 2002. For example, if the average absolute pitch of the sample data used for a particular voice type is 150 Hz and the base pitch is 30 Hz, then the value 120 Hz is stored in the average pitch table 2006. From this average pitch and the base pitch, the second pitch modifier 2004 calculates a certain constant value and adds this constant value to all of the modified point pitches, thereby executing the second modification of the point pitch pattern.

On the basis of the phonation times and the twice-modified modified point pitch pattern, the pitch-pattern interpolator 2005 performs linear interpolation or spline interpolation between the phonemes to generate a pitch pattern, which is output to the synthesis parameter generator 206.

Figure 21:
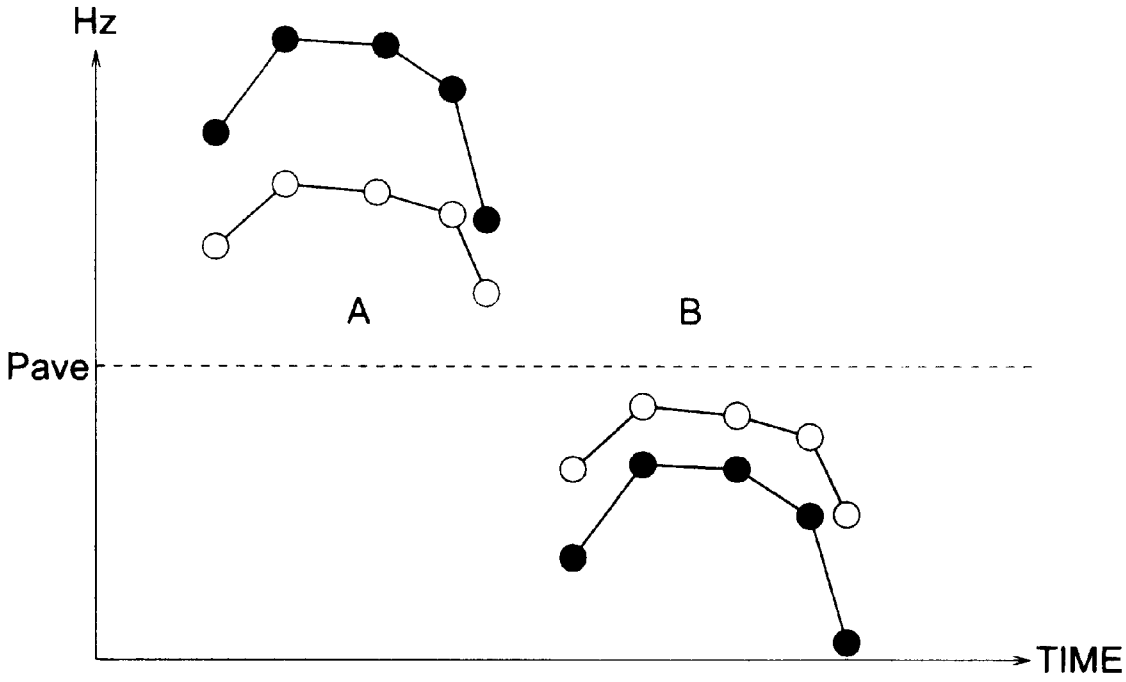
FIG. 21 illustrates pitch control performed by the pitch pattern generator in FIG. 20.

The combined effect of the two modifications of the point pitch pattern made in the third embodiment is illustrated in FIG. 21. The dotted line represents the average pitch ($P_{ave}$) stored in the average pitch table 2006. The white dots represent the original point pitch patterns of two words A and B. If the intonation level of both words is increased, the modifications performed by the first pitch modifier 2003 and second pitch modifier 2004 produce point pitch patterns similar to those indicated by the black dots. Pitches higher than the average speech pitch ($P_{ave}$) move up, while pitches lower than the average speech pitch ($P_{ave}$) move down. Pitches equal to the average speech pitch would be left unchanged (although no such pitches are shown).

Figure 22:
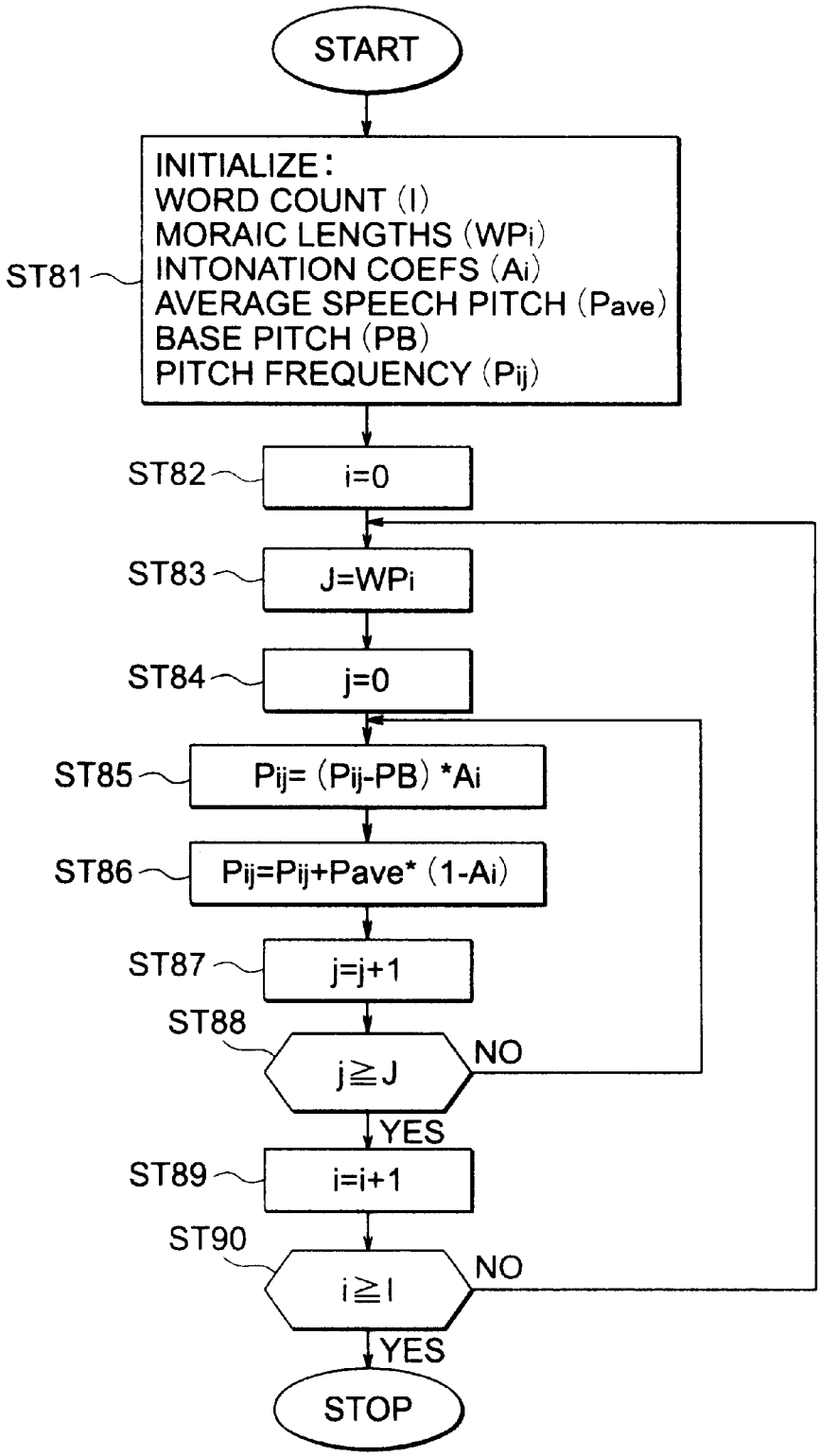
FIG. 22 is a flowchart describing the operation of the pitch pattern generator in FIG. 20.

To describe this intonation control process more precisely, the process is depicted in flowchart form in FIG. 22. This flowchart shows the processing carried out by the first and second pitch modifiers 2003, 2004 in FIG. 20.

First, in step ST81 in FIG. 22, the following parameters are initialized: the word count of the input sentence (I), the moraic length of the i-th word ($WP_i$), the intonation control coefficient of the i-th word ($A_i$), the average pitch of the designated voice ($P_{ave}$), the base pitch (PB), and the central vowel pitch frequency of the j-th mora in the i-th word ($P_{ij}$), where i and j are integers as described in the first embodiment.

In step ST82, the word counter (i) is initialized to zero.

In step ST83, the moraic length of the i-th word is assigned to a variable J.

In steps ST84 to ST90, the intonation control process is carried out on the i-th word. First, the mora counter (j) is initialized to zero in step ST84. Next, a first modification is performed on the j-th mora in step ST85, as follows.

$$P_{ij}=(P_{ij}-PB)*A_i \tag{16}$$

This step multiples the component of the point pitch exceeding the base pitch PB by the predetermined intonation control coefficient.

Next, a second modification is performed on the once-modified point pitch in step ST86, as follows.

$$P_{ij}=P_{ij}+P_{ave}*(1-Ai) \tag{17}$$

The resulting point pitch, like the average speech pitch $P_{ave}$, is a value relative to the base pitch PB. If necessary, PB can be added to the result to obtain an absolute pitch.

The effect of the two modifications is that intonation control is carried out on the pitch values relative to the average speech pitch. If PW0 is the average pitch of the word before the modifications, then from equations (16) and (17), the average pitch PW1 after the modifications has the following value.

$$PW1=(PW0-PB)*A_i+P_{ave}*(1-A_i) \tag{18}$$

The average pitch $P_{ave}$, however, is a value relative to the base pitch PB, so the quantity (PW0−PB) can be replaced by PW0, giving the following value for PW1.

$$PW1=A_i*(PW0-P_{ave})+P_{ave} \tag{19}$$

This equation means that in the average pitch PWO of the word, only the component relative to the average speech pitch $P_{ave}$ is subject to intonation control, so from the overall standpoint, the average pitch does not vary from $P_{ave}$, even though the average pitches of individual words may increase or decrease.

The mora counter (j) is incremented in step ST87 and compared with the moraic length of the current word (J) in step ST88. If j is equal to or greater than J, processing of the current word has been completed, so the process proceeds to the step ST89. Otherwise, the process returns to step ST85 to modify the pitch of the next mora.

The word counter (i) is incremented in step ST89 and compared with the total number of words (I) in step ST90. If i is equal to or greater than I, the last word has been processed, so the process stops. Otherwise, the process returns to step ST83 to modify the pitches of the next word.

As described above, the third embodiment performs intonation control in relation to the average speech pitch of the designated voice type, so that this average pitch is left invariant. The user can accordingly specify a uniformly high or low level of intonation for an entire sentence or an entire series of sentences, without altering the average pitch of the designated voice type.

The processing performed in this embodiment is also simpler than the processing performed in the preceding embodiments.

The calculations described in this embodiment can be varied in many ways.

In one possible variation, the first pitch modifier 2003 multiplies each point pitch value $P_{ij}$ by the intonation coefficient $A_i$, and the second pitch modifier 2004 adds the constant value $(PB+P_{ave})*(1-A_i)$, thereby obtaining an absolute pitch instead of a pitch relative to the base pitch PB.

In another possible variation, the first pitch modifier 2003 multiplies the difference between $P_{ij}$ and the average speech pitch $(P_{ij}-PB-P_{ave})$ by $A_i$, and the second pitch modifier 2004 adds $(PB+P_{ave})$ to the result, again obtaining the result as an absolute pitch.

As noted earlier, the speech-element dictionary storing the speech elements on which the synthesized speech is based is generated from actual human utterances, that is, from recorded speech data. The normal practice in constructing the speech-element dictionary is to extract pitch waveforms, each equivalent to the impulse response caused by one vibration of the human vocal chords. In the synthesis process, these pitch waveforms are added together in an overlapping manner, with adjustment of the overlapping intervals, to generate various pitch patterns. The speech data, however, are usually obtained by having the speaker speak meaningless words in a monotone; that is, in an intentionally flat voice with as few pitch variations as possible. If the synthesized speech consists of pitch patterns close to the original monotone pitch, the speech quality tends to be comparatively good, but if the pitch patterns differ greatly from the original monotone pitch, the synthesized speech may sound distorted. In the prior art, designating either a high or a low intonation control level tends to increase the distortion because it moves the pitches away from their normal level.

The fourth embodiment, described below, addresses this problem by comparing pitch patterns with the monotone pitch employed when the speech-element dictionary was created, and controlling intonation so as to avoid large differences between the synthesized pitch and that monotone pitch.

The fourth embodiment also differs from the prior art in using a simplified pitch pattern, as described in the second embodiment, in the intonation control process.

Figure 23:
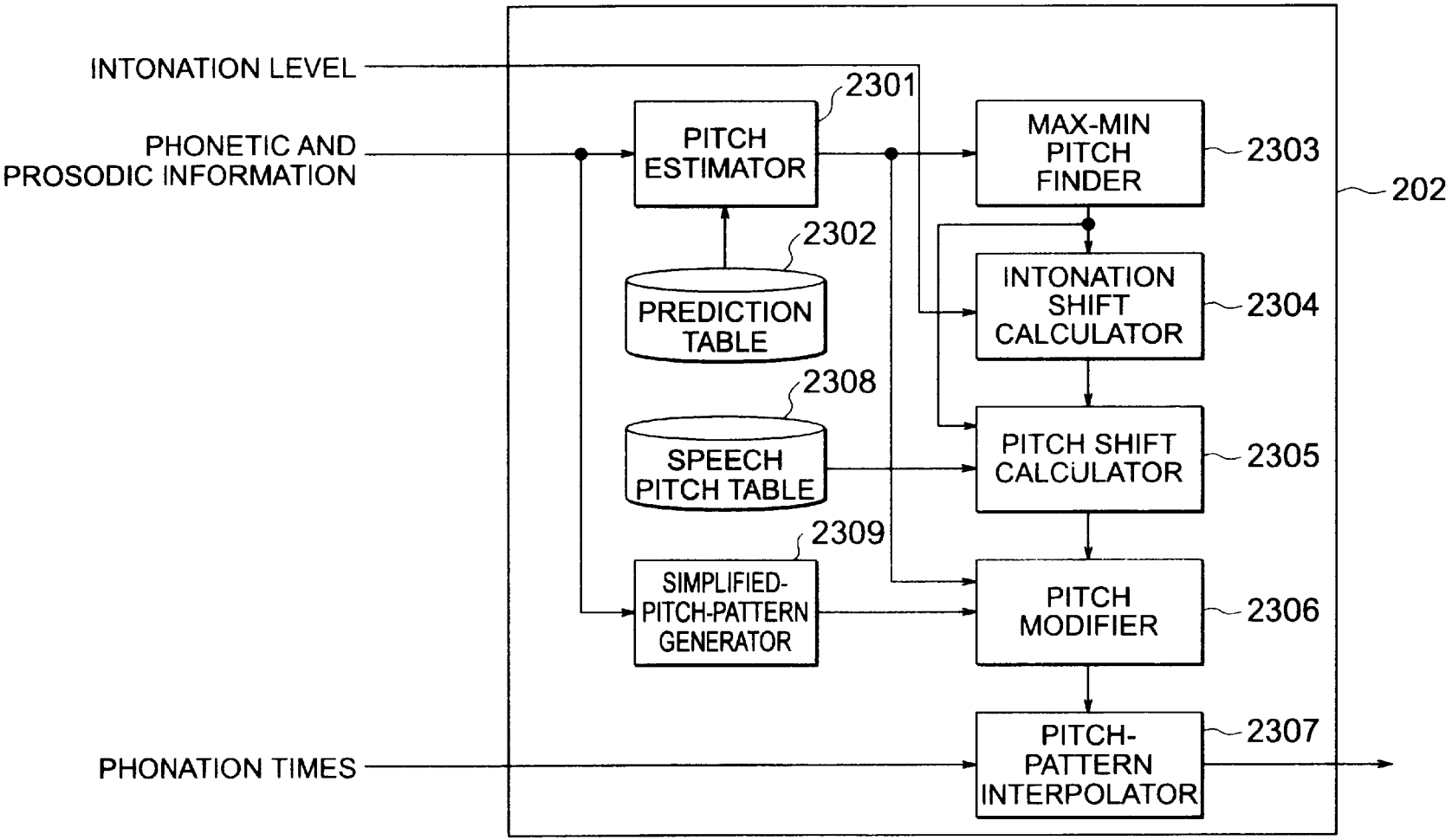
FIG. 23 is a block diagram of a fourth pitch pattern generator embodying the invention.

Referring to FIG. 23, in the fourth embodiment, as in the prior art, the input to the pitch pattern generator 202 includes phonetic and prosodic information obtained from the intermediate language analyzer 201 in FIG. 2, the phonation times determined by the phonation time generator 203, user-designated intonation levels, and a voice type designation (not visible). The phonetic and prosodic information is supplied to a pitch estimator 2301 and a simplified-pitch-pattern generator 2309. The pitch estimator 2301 uses the received information to estimate point pitches as in the preceding embodiments and the prior art. As explained above, the pitch estimation process is based on a statistical technique, such as Hayashi's well-known first quantification method, that determines control rules from a speech data base including a large number of actual human utterances. The central vowel pitch of each mora is estimated by use of a pre-trained prediction table 2302. The central vowel pitches output from the pitch estimator 2301 form an original point pitch pattern that is supplied to a maximum-minimum pitch finder 2303 and a pitch modifier 2306.

The maximum-minimum pitch finder 2303 divides the original point pitch pattern into words, finds the maximum and minimum point pitches in each word, and supplies these values to an intonation shift calculator 2304 and a pitch shift calculator 2305. The intonation shift calculator 2304 also receives the user-designated intonation levels.

For each word, the intonation shift calculator 2304 supplies the pitch shift calculator 2305 with an intonation shift calculated from the received maximum point pitch, minimum point pitch, and intonation level. This intonation shift provides a basis for calculating pitch shifts that will be used in modifying the point pitches.

The pitch shift calculator 2305 receives the maximum and minimum pitches found by the maximum-minimum pitch finder 2303, the intonation shifts calculated by the intonation shift calculator 2304, and a speech pitch from a speech pitch table 2308. As explained above, the speaker supplying speech samples for each voice type speaks substantially in a monotone. The pitch of this monotone is measured when the speech-element dictionary 105 (in FIG. 1) is created, by calculation of the average pitch of all of that speaker's speech samples that are stored in the speech data base from which the speech-element dictionary is compiled. The calculated pitch is stored as a speech pitch in the speech pitch table 2308, which thus stores one speech pitch value for each voice type represented in the speech-element dictionary 105. The pitch shift calculator 2305 reads the speech pitch value of the voice type designated for the word being processed, compares this speech pitch with the maximum and minimum point pitches of the word, calculates the values of two pitch shifts for use in modifying the point pitch pattern of the word, and supplies the calculated pitch shifts to the pitch modifier 2306.

The simplified-pitch-pattern generator 2309 receives the phonetic and prosodic information from the intermediate language analyzer 201, creates a pitch pattern in which the central vowel pitch of each mora is simply classified as high or low, and supplies this simplified pitch pattern to the pitch modifier 2306.

The pitch modifier 2306 receives the simplified pitch pattern from the simplified-pitch-pattern generator 2309, the original point pitch pattern from the pitch estimator 2301, and the pitch shifts supplied by the pitch shift calculator 2305, modifies the point pitches on the basis the received information, and supplies the results to the pitch-pattern interpolator 2307.

The pitch-pattern interpolator 2307 receives the phonation times and the modified point pitch pattern, and performs linear interpolation or spline interpolation between the supplied point pitches to generate a pitch pattern, which is output to the synthesis parameter generator 206 in FIG. 2.

The operation of the fourth embodiment will now be described in more detail with reference to FIGS. 23 to 25. The description will be confined to the generation of the pitch pattern, which differs from the prior art.

First, phonetic and prosodic information is input from the intermediate language analyzer 201 (in FIG. 2) to the pitch estimator 2301. When the information for one sentence has been input, central vowel pitches are estimated by use of the prediction table 2302, as described in the preceding embodiments, to generate the original point pitch pattern.

The simplified-pitch-pattern generator 2309, like the pitch estimator 2301, receives the phonetic information and prosodic information supplied by the intermediate language analyzer 201. Operating as described in the second embodiment, the simplified-pitch-pattern generator 2309 classifies each point pitch as either high or low and sends a simplified pitch pattern indicating these high-or-low classifications to the pitch modifier 2306.

When the pitch estimator 2301 has estimated the central vowel pitches for all morae in one sentence, the resulting original point pitch pattern is supplied to the maximum-minimum pitch finder 2303 and the pitch modifier 2306. The supplied information is organized into word units, specifying, for example, the pitch of the m-th mora of the n-th word (m and n being non-negative integers).

For each word, the maximum-minimum pitch finder 2303 finds the maximum point pitch and minimum point pitch in the word, and passes these two point pitch frequencies to the intonation shift calculator 2304 and pitch shift calculator 2305.

The intonation shift calculator 2304 takes the difference between the maximum point pitch and minimum point pitch, and multiplies the difference by a coefficient corresponding to the intonation level specified by the user. The result of this calculation is the intonation shift that is passed to the pitch shift calculator 2305. The user has, for example, a selection of three predetermined levels: level one (x1.5), level two (x1.0), and level three (x0.5). The values of the corresponding coefficients are one-half (0.5) for level one, zero (0) for level two, and minus one-half (−0.5) for level three.

The pitch shift calculator 2305 uses the maximum and minimum pitch values found by the maximum-minimum pitch finder 2303, the intonation shift calculated by the intonation shift calculator 2304, and the speech pitch value read from the speech pitch table 2308 to calculate the pitch shifts that will be used to modify the point pitch pattern of the word. Separate pitch shifts are calculated for modifying point pitches classified as high and low by the simplified-pitch-pattern generator 2309. The pitch shifts also depend on whether the point pitches in the word are all higher than, all lower than, or substantially equal to the speech pitch read from the speech pitch table 2308. Further details will be given below.

The pitch modifier 2306 uses the calculated pitch shifts to modify the original point pitch pattern according to the high-or-low classifications made in the simplified pitch pattern. The modified point pitch pattern is output to the pitch-pattern interpolator 2307.

The pitch-pattern interpolator 2307 receives the phonation times and the modified point pitch pattern, and performs linear interpolation or spline interpolation between the supplied point pitches to generate a pitch pattern, which is output to the synthesis parameter generator 206 (shown in FIG. 2).

Figure 24:
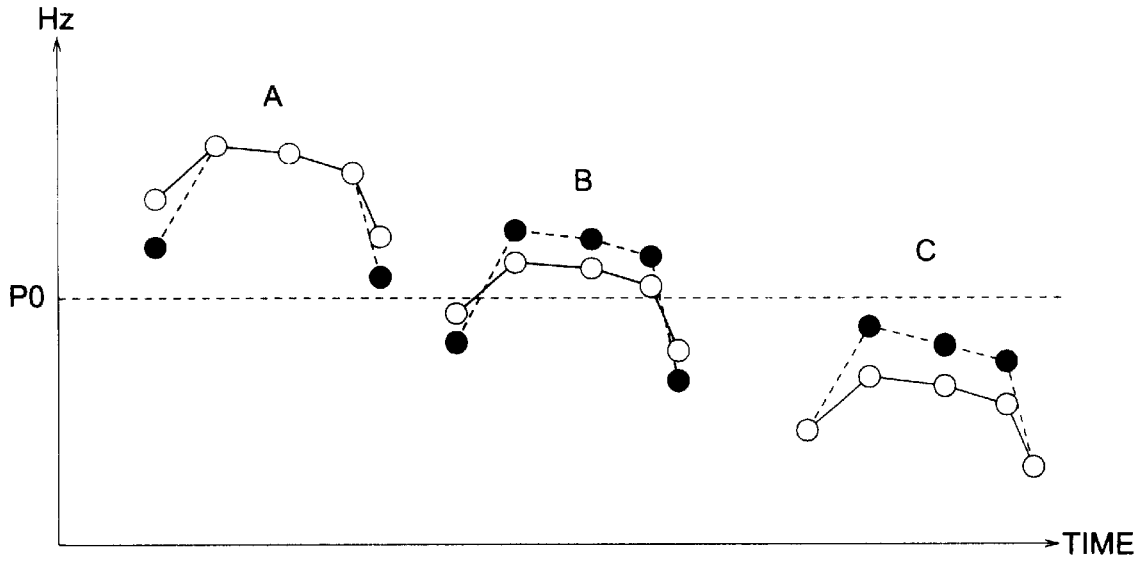
FIG. 24 illustrates pitch control performed by the pitch pattern generator in FIG. 23.

FIG. 24 illustrates the processing of three words A, B, C, all having five morae and type-four accents, thus having a low-high-high-high-low simplified pitch pattern. The user has designated intonation level one (x1.5), and chosen a voice type that had the average speech pitch (P0) indicated by the horizontal dotted line. The white dots indicate the original point pitches; the black dots indicate the modified point pitches. In word A, in which the original point pitches are all higher than the speech pitch (P0), the low pitches are shifted down, while the high pitches are left unchanged. In word B, in which the original point pitches are substantially equal to the speech pitch (P0), the high pitches are shifted up and the low pitches are shifted down. In word C, in which the original point pitches are all lower than the speech pitch (P0), the high pitches are shifted up while the low pitches are left unchanged.

Figure 25:
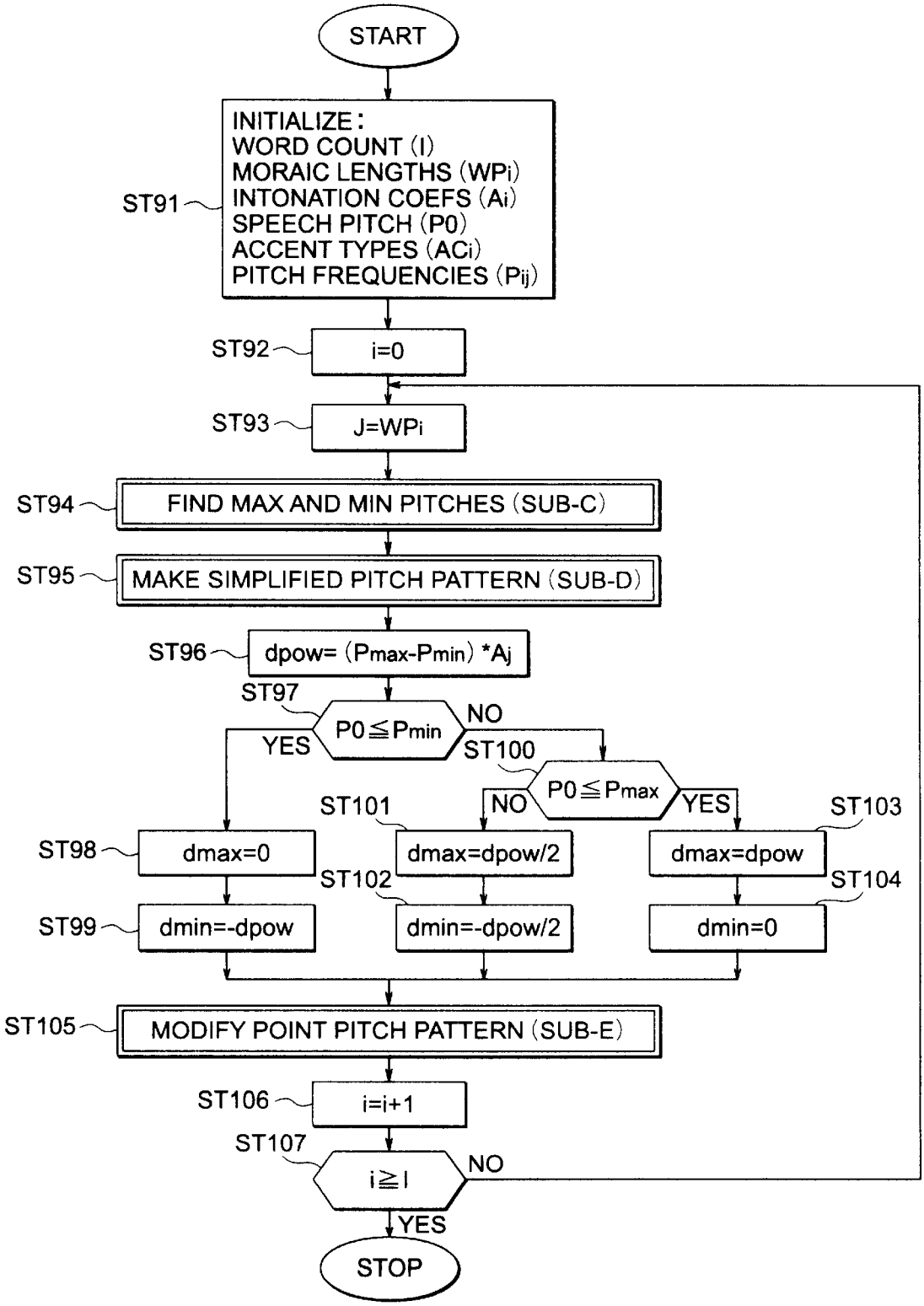
FIG. 25 is a flowchart describing the operation of the pitch pattern generator in FIG. 23.

The flowchart in FIG. 25 will be used to describe the intonation control process more precisely. This flowchart indicates the processing carried out by the maximum-minimum pitch finder 2303, intonation shift calculator 2304, pitch shift calculator 2305, and pitch modifier 2306 in FIG. 23.

First, in step ST91 in FIG. 25, the following parameters are initialized: the word count of the input sentence (I), the moraic length of the i-th word ($WP_i$), the intonation control coefficient of the i-th word ($A_i$), the speech pitch (P0), the accent type of the i-th word ($AC_i$), and the central vowel pitch frequency of the j-th mora in the i-th word ($P_{ij}$), where i and j are integers as described in the first embodiment.

In step ST92, the word counter (i) is initialized to zero.

In step ST93, the moraic length of the i-th word is assigned to a variable J.

In steps ST94 to ST107, the intonation control process is carried out on the i-th word.

First, the maximum point pitch $P_{max}$ and minimum point $P_{min}$ are found in step ST94 by the subroutine C described in the second embodiment. Subroutine C is illustrated in FIG. 17.

In step ST95, the simplified pitch pattern of the i-th word is constructed from the accent type and moraic length of the word by the subroutine D described in the second embodiment. The simplified pitch pattern is a binary pattern that classifies each point pitch as high or low. Subroutine D is illustrated in FIG. 18.

In step ST96, an intonation shift (dpow) is calculated from the maximum point pitch $P_{max}$, the minimum point pitch $P_{min}$, and the intonation control coefficient $A_i$ as follows.

$$dpow=(P_{max}-P_{min})*A_i \tag{20}$$

In step ST97, the speech pitch P0 and the minimum pitch $P_{min}$ are compared. The process proceeds to step ST98 if the speech pitch is equal to or less than the minimum pitch $P_{min}$, and to step ST100 otherwise.

In steps ST98 and ST99, since the speech pitch is equal to or less than all point pitches in the word, the following values are assigned to the high pitch shift (dmax) and low pitch shift (dmin).

$$d\max = 0 \tag{21}$$

$$d\min = -dpow \tag{22}$$

In step ST100, the speech pitch P0 and the maximum pitch $P_{max}$ are compared. The process proceeds to step ST101 if the speech pitch is equal to or less than the maximum pitch, and to step ST103 otherwise.

In steps ST101 and ST102, since the speech pitch P0 is within the range between the maximum pitch Pmax and minimum pitch $P_{min}$, the point pitches in the word are considered to be substantially equal to the speech pitch P0, and the following values are assigned to the high pitch shift (dmax) and the low pitch shift (dmin).

$$d\max = dpow/2 \tag{23}$$

$$d\min = -dpow/2 \tag{24}$$

In steps ST103 and ST104, since the speech pitch P0 is greater than all point pitches in the word, the following values are assigned to the high pitch shift (dmax) and low pitch shift (dmin).

$$d\max = dpow \tag{25}$$

$$d\min = 0 \tag{26}$$

As is evident from equations (21) to (26), the difference between the high and low pitch shifts (dmax and dmin) is always equal to the intonation shift (dpow).

In step ST105, the original point pitch pattern is modified by use of the high and low pitch shifts (dmax and dmin). The modification is carried out by the subroutine E described in the second embodiment. Subroutine E is illustrated in FIG. 19.

When the point pitch pattern has been modified, the word counter (i) is incremented in step ST106 and compared with the total number of words (I) in step ST107. If i is equal to or greater than I, the last word has been processed, so the process stops. Otherwise, the process returns to step ST93 to process the next word.

In the fourth embodiment, as explained above, the point pitch pattern of a word is compared with the substantially monotone pitch of the speech data from which the dictionary of speech elements of the designated voice type was compiled. If the entire point pitch pattern is higher than this speech pitch, then only the low pitches in the point pitch pattern are modified. Conversely, if the entire point pitch pattern is lower than this speech pitch, only the high pitches in the point pitch pattern are modified. Accordingly, the modification does not generate any extremely high or low pitches, and avoids the problem of distortion due to the wide difference between such pitches and the actual speaking pitch of the speaker on whose voice the synthesis is based. The fourth embodiment can be used to generate synthesized speech that is clear and easy to listen to.

In all of the preceding embodiments, the calculations performed when the user specifies the x1.0 intonation control level lead to zero modification (no modification) of the point pitch pattern. Accordingly, these calculations can simply be omitted, and the pitch-pattern interpolator can operate on the original point pitch pattern generated by the pitch estimator. It suffices to add a suitable switch unit, similar to the one in FIG. 3, to the structures shown in FIGS. 6, 14, 20, and 23.

The invention is not limited to the use of Hayashi's first quantification method to estimate the point pitches. Since the invention is directed toward processing carried out after the point pitch pattern has been generated, the point pitches can be estimated by any suitable statistical method or other method. For example, the point pitch pattern of each word may be generated by predetermined rules based on the accent type of the word and its moraic length.

In the second and fourth embodiments, the determination of the simplified pitch pattern included steps of determining whether the second point pitch represented a dependent sound and, if it did, classifying the first point pitch as high. The process can be streamlined, however, by generating the simplified pitch pattern only from the accent type. Alternatively, the simplified pitch pattern can be generated by setting a threshold between the maximum and minimum point pitches $P_{max}$ and $P_{min}$, and classifying point pitches as high or low according to whether or not they exceed the threshold.

In the third embodiment, the invariant pitch $P_{ave}$ does not have to be exactly equal to the average pitch of the designated speaker's voice. An arbitrary value can be designated as $P_{ave}$, although it is necessary to use different values for male and female voices.

In the fourth embodiment, the pitch shifts applied to high and low point pitches when the speech pitch is disposed between the maximum and minimum point pitches $P_{max}$ and $P_{min}$ do not need to have equal magnitudes of dpow/2. It suffices for the difference between the two shifts (dmax−dmin) to be equal to dpow. For example, it is possible to add dpow/4 to high pitches and −dpow*3/4 to low pitches.

The invention has been described in relation to a Japanese text-to-speech conversion system, but is applicable to other pitch-accented languages, and to pitch control in stress-accented languages.

The invention can be practiced in either hardware or software.

Those skilled in the art will recognize that further variations are possible within the scope claimed below.

What is claimed is:

1. A method of controlling the intonation of synthesized speech according to a designated intonation level, comprising the steps of:

obtaining an original pitch pattern of a word to be synthesized, the original point pitch pattern including a first point pitch, a last point pitch, and at least one intermediate point pitch disposed temporally between the first point pitch and the last point pitch;

constructing a pitch slope line from the first point pitch to the last point pitch;

modifying each said intermediate point pitch by finding a temporally matching point on the pitch slope line and adjusting a distance of the intermediate point pitch from the temporally matching point according to the designated intonation level, thereby obtaining a modified point pitch pattern; and synthesizing a speech signal of the word from the modified point pitch pattern.

2. The method of claim 1, wherein said step of obtaining makes each said intermediate point pitch at least as high as the temporally matching point on the pitch slope line.

3. The method of claim 1, wherein said step of modifying selects a coefficient according to the designated intonation level, and multiplies said distance by said coefficient.

4. A text-to-speech conversion apparatus receiving an input text including at least one word and intonation control information designating a desired intonation level of the word, having a speech-element dictionary storing speech elements, a text analyzer generating phonetic and prosodic information from the input text, a parameter generator using the phonetic and prosodic information to generate parameters at least specifying a fundamental frequency, selecting speech elements from the speech-element dictionary, and specifying phonation times of the selected speech elements, and a waveform generator using said parameters to synthesize a speech signal by combining waveforms corresponding to the selected speech elements, the parameter generator including a pitch pattern generator, the pitch pattern generator comprising:

a pitch estimator generating, for each word in the input text, an original point pitch pattern including a first point pitch, a last point pitch, and at least one intermediate point pitch disposed temporally between the first point pitch and the last point pitch;

an intonation control component calculator coupled to the pitch estimator, constructing a pitch slope line from the first point pitch to the last point pitch and finding, for each said intermediate point pitch, a temporally matching point on the pitch slope line and a distance of the intermediate point pitch from the temporally matching point;

a pitch modifier coupled to the intonation control component calculator, modifying each said intermediate point pitch by adjusting said distance according to the desired intonation level, thereby obtaining a modified point pitch pattern; and a pitch-pattern interpolator coupled to the pitch modifier, generating a pitch pattern from the modified point pitch pattern by interpolation.

5. The apparatus of claim 4, wherein the pitch estimator makes each said intermediate point pitch at least as high as the temporally matching point on the pitch slope line.

6. The apparatus of claim 4, wherein the pitch modifier selects a coefficient according to the desired intonation level, and multiplies said distance by said coefficient.

7. A method of controlling the intonation of synthesized speech according to a designated intonation level, comprising the steps of:

obtaining an original point pitch pattern of a word to be synthesized, the original point pitch pattern including a series of point pitches;

generating a simplified pitch pattern by classifying each point pitch in the original point pitch pattern as high or low;

calculating a high pitch shift and a low pitch shift according to the designated intonation level;

adding the high pitch shift to each point pitch in the original point pitch pattern classified as high in the simplified pitch pattern, and adding the low pitch shift to each point pitch in the original point pitch pattern classified as low in the simplified pitch pattern, thereby obtaining a modified point pitch pattern; and synthesizing a speech signal of the word from the modified point pitch pattern.

8. The method of claim 7, wherein the word has a pitch accent type, and said simplified pitch pattern is generated according to said pitch accent type.

9. The method of claim 7, wherein:

the original point pitch pattern begins with a first point pitch representing a first sound in the word;

the original point pitch pattern includes a second point pitch, immediately following the first point pitch, the second point pitch representing a second sound in the word; and the first point pitch is classified as high in the simplified pitch pattern if the second sound is dependent on the first sound.

10. The method of claim 7, wherein the high pitch shift and the low pitch shift have equal magnitude and opposite sign.

11. The method of claim 10, further comprising the steps of:

finding a maximum point pitch and a minimum point pitch in the original point pitch pattern;

taking a difference between the maximum point pitch and the minimum point pitch; and selecting a coefficient according to the designated intonation level;

said equal magnitude being made proportional to said difference multiplied by said coefficient.

12. The method of claim 7, further comprising the steps of:

finding a maximum point pitch and a minimum point pitch in the original point pitch pattern; and comparing the maximum point pitch and the minimum point pitch with a predetermined speech pitch;

wherein the high pitch shift is calculated as zero if the minimum point pitch exceeds the predetermined speech pitch, and the low pitch shift is calculated as zero if the predetermined speech pitch exceeds the maximum point pitch.

13. The method of claim 12, further comprising the steps of:

taking a difference between the maximum point pitch and the minimum point pitch; and selecting a coefficient according to the designated intonation level;

wherein the high pitch shift and the low pitch shift are calculated so that they differ by an amount proportional to said difference multiplied by said coefficient.

14. The method of claim 12, wherein the step of synthesizing a speech signal includes referring to a speech-element dictionary generated from speech samples produced by a human speaker speaking in a monotone pitch, and the predetermined speech pitch is substantially equal to said monotone pitch.

15. A text-to-speech conversion apparatus receiving an input text including at least one word and intonation control information designating a desired intonation level of the word, having a speech-element dictionary storing speech elements, a text analyzer generating phonetic and prosodic information from the input text, a parameter generator using the phonetic and prosodic information to generate parameters at least specifying a fundamental frequency, selecting speech elements from the speech-element dictionary, and specifying phonation times of the selected speech elements, and a waveform generator using said parameters to synthesize a speech signal by combining waveforms corresponding to the selected speech elements, the parameter generator including a pitch pattern generator, the pitch pattern generator comprising:

a pitch estimator generating, for each word in the input text, an original point pitch pattern including a series of point pitches;

a simplified-pitch-pattern generator generating a simplified pitch pattern by classifying each point pitch in the original point pitch pattern as high or low;

a pitch shift calculator calculating a high pitch shift and a low pitch shift according to the desired intonation level;

a pitch modifier coupled to the pitch estimator 1401, the simplified-pitch-pattern generator, and the pitch shift calculator, adding the high pitch shift to each point pitch in the original point pitch pattern classified as high in the simplified pitch pattern, and adding the low pitch shift to each point pitch in the original point pitch pattern classified as low in the simplified pitch pattern, thereby obtaining a modified point pitch pattern; and a pitch-pattern interpolator coupled to the pitch modifier, generating a pitch pattern from the modified point pitch pattern by interpolation.

16. The apparatus of claim 15, wherein the word has a pitch accent type, and said simplified-pitch-pattern generator generates the simplified pitch pattern according to said pitch accent type.

17. The apparatus of claim 15, wherein:

the original point pitch pattern begins with a first point pitch representing a first sound in the word;

the original point pitch pattern includes a second point pitch, immediately following the first point pitch, the second point pitch representing a second sound in the word; and the simplified-pitch-pattern generator classifies the first point pitch as high if the second sound is dependent on the first sound.

18. The apparatus of claim 15, wherein the high pitch shift and the low pitch shift have equal magnitude and opposite sign.

19. The apparatus of claim 18, further comprising a maximum-minimum pitch finder coupled to the pitch estimator, finding a maximum point pitch and a minimum point pitch in the original point pitch pattern, wherein the pitch shift calculator takes a difference between the maximum point pitch and the minimum point pitch, selects a coefficient according to the desired intonation level, and makes said equal magnitude proportional to said difference multiplied by said coefficient.

20. The apparatus of claim 15, further comprising a maximum-minimum pitch finder coupled to the pitch estimator, finding a maximum point pitch and a minimum point pitch in the original point pitch pattern, wherein the pitch shift calculator compares the maximum point pitch and the minimum point pitch with a predetermined speech pitch, sets the high pitch shift to zero if the minimum point pitch exceeds the predetermined speech pitch, and sets the low pitch shift to zero if the predetermined speech pitch exceeds the maximum point pitch.

21. The apparatus of claim 20, wherein the pitch shift calculator also takes a difference between the maximum point pitch and the minimum point pitch, selects a coefficient according to the desired intonation level, and makes the high pitch shift differ from the low pitch shift by an amount proportional to said difference multiplied by said coefficient.

22. The apparatus of claim 15, wherein the speech-element dictionary is generated from speech samples produced by a human speaker speaking in a monotone pitch, and said predetermined speech pitch is substantially equal to said monotone pitch.

23. A method of controlling the intonation of synthesized speech according to a designated intonation level, comprising the steps of:

obtaining an original point pitch pattern of a word to be synthesized, the original point pitch pattern including a series of point pitches;

designating an invariant pitch representing a typical pitch level of the synthesized speech;

calculating a constant value according to the invariant pitch;

adjusting each point pitch in the original point pitch pattern according to the designated intonation level to obtain a first modified point pitch pattern;

adding the constant value to each point pitch in the first modified point pitch pattern to obtain a second modified point pitch pattern; and synthesizing a speech signal of the word from the second modified point pitch pattern;

wherein the constant value is calculated so that a point pitch having said invariant pitch in the original point pitch pattern also has said invariant pitch in the second modified point pitch pattern.

24. The method of claim 23, wherein the step of obtaining an original point pitch pattern includes referring to a prediction table generated from speech samples produced by a human speaker, and the invariant pitch is an average pitch of the speech samples.

25. The method of claim 23, wherein said step of adjusting includes:

selecting a coefficient according to the designated intonation level;

taking a difference between each said point pitch and the invariant pitch; and multiplying said difference by said coefficient;

said constant value being equal to said invariant pitch.

26. The method of claim 23, wherein said step of adjusting employs a predetermined base pitch at least as low as each said point pitch, and includes:

selecting a coefficient according to the designated intonation level;

taking a first difference between each said point pitch and the predetermined base pitch; and multiplying the first difference by said coefficient.

27. The method of claim 26, wherein said step of calculating a constant value includes:

taking a second difference between unity and said coefficient; and multiplying the invariant pitch by the second difference.

28. A text-to-speech conversion apparatus receiving an input text including at least one word and intonation control information designating a desired intonation level of the word, having a speech-element dictionary storing speech elements, a text analyzer generating phonetic and prosodic information from the input text, a parameter generator using the phonetic and prosodic information to generate parameters at least specifying a fundamental frequency, selecting speech elements from the speech-element dictionary, and specifying phonation times of the selected speech elements, and a waveform generator using said parameters to synthesize a speech signal by combining waveforms corresponding to the selected speech elements, the parameter generator including a pitch pattern generator, the pitch pattern generator comprising:

a pitch estimator generating, for each word in the input text, an original point pitch pattern including a series of point pitches;

a first pitch modifier coupled to the pitch estimator, adjusting each point pitch in the original point pitch pattern according to the desired intonation level to obtain a first modified point pitch pattern;

a pitch table storing an invariant pitch;

a second pitch modifier coupled to the first pitch modifier and the pitch table, calculating a constant value according to the invariant pitch, and adding the constant value to each point pitch in the first modified point pitch pattern to obtain a second modified point pitch pattern; and a pitch-pattern interpolator coupled to the second pitch modifier, generating a pitch pattern from the second modified point pitch pattern by interpolation;

wherein the second pitch modifier calculates the constant value so that a point pitch equal to said invariant pitch in the original point pitch pattern is also equal to said invariant pitch in the second modified point pitch pattern.

29. The apparatus of claim 28, wherein the pitch pattern generator further comprises a prediction table generated from speech samples produced by a human speaker, the pitch estimator refers to the prediction table when generating the original point pitch pattern, and the invariant pitch is an average pitch of the speech samples.

30. The apparatus of claim 28, wherein:

the first pitch modifier takes a difference between each said point pitch and the invariant pitch and multiplies said difference by said coefficient; and the second pitch modifier uses the invariant pitch as said constant value.

31. The apparatus of claim 28, wherein the first pitch modifier employs a predetermined base pitch at least as low as each said point pitch, takes a first difference between each said point pitch and the predetermined base pitch, and multiplies the first difference by said coefficient.

32. The apparatus of claim 31, wherein the second pitch modifier takes a second difference between unity and said coefficient, and multiplies the invariant pitch by the second difference in calculating said constant value.

* * * * *